US007811735B2

(12) United States Patent
Nakamura et al.

(10) Patent No.: US 7,811,735 B2
(45) Date of Patent: Oct. 12, 2010

(54) TONER, AND IMAGE FORMING METHOD, IMAGE FORMING APPARATUS, AND PROCESS CARTRIDGE USING THE TONER

(75) Inventors: Minoru Nakamura, Takarazuka (JP); Chiyoshi Nozaki, Ohtsu (JP); Tsuyoshi Nozaki, Ikeda (JP); Atsushi Yamamoto, Kawanishi (JP)

(73) Assignee: Ricoh Company Limited, Tokyo (JP)

( * ) Notice: Subject to any disclaimer, the term of this patent is extended or adjusted under 35 U.S.C. 154(b) by 458 days.

(21) Appl. No.: 11/772,404

(22) Filed: Jul. 2, 2007

(65) Prior Publication Data

US 2008/0124635 A1 May 29, 2008

(30) Foreign Application Priority Data

Jun. 30, 2006 (JP) ..... 2006-180786

(51) Int. Cl.
*G03G 9/087* (2006.01)

(52) U.S. Cl. ..... 430/109.4; 430/109.3; 399/159

(58) Field of Classification Search ..... 430/48, 430/109.4, 109.3
See application file for complete search history.

(56) References Cited

U.S. PATENT DOCUMENTS 5,302,486 A * 4/1994 Patel et al. ..... 430/137.12
2004/0131961 A1 7/2004 Watanabe et al.
2005/0058927 A1* 3/2005 Mikuriya et al. ..... 430/110.2
2006/0166122 A1* 7/2006 Patel et al. ..... 430/110.2
2006/0204882 A1 9/2006 Nozaki et al.
2006/0210902 A1 9/2006 Nakamura et al.
2006/0240349 A1 10/2006 Watanabe et al.
2006/0275686 A1 12/2006 Kadota et al.
2006/0292474 A1 12/2006 Mikuriya et al.
2007/0026335 A1 2/2007 Yamamoto et al.
2007/0059625 A1 3/2007 Yamamoto et al.

FOREIGN PATENT DOCUMENTS

JP 2004-151533 5/2004
JP 2004-170483 6/2004
JP 2004-271919 9/2004
JP 2005-266383 9/2005
JP 2005-300937 10/2005

OTHER PUBLICATIONS

Polymer Handbook 4th Edition, Wiley-Interscience, vol. 2, Section VII (Table9 Hansen Solubility Parameters of liquids at 25° C.

* cited by examiner

*Primary Examiner*—John L Goodrow
(74) *Attorney, Agent, or Firm*—Oblon, Spivak, McClelland, Maier & Neustadt, L.L.P.

(57) ABSTRACT

A toner is provided including a binder resin and a colorant, wherein the toner has a displacement-load curve in which a maximum compression strength is from 0.65 to 1.0 mN and a slope of a line through an origin point and a first shoulder is not less than 1.1 mN/μm; along with an image forming method, an image forming apparatus, and a process cartridge using the toner.

18 Claims, 4 Drawing Sheets

TONER, AND IMAGE FORMING METHOD, IMAGE FORMING APPARATUS, AND PROCESS CARTRIDGE USING THE TONER

BACKGROUND THE INVENTION

1. Field of the Invention

The present invention relates to a toner for use in electrophotography. In addition, the present invention also relates to an image forming method, an image forming apparatus, and a process cartridge using the toner.

2. Discussion of the Background

For the purpose of improving quality of electrophotographic images, recently toners are being modified to have a smaller particle diameter. The smaller particle diameter a toner has, the lower fluidity the toner has. When a toner has poor fluidity, the toner tends to aggregate and transferability thereof deteriorates. As a result, hollow defects tend to occur in the resultant image. In particular, this phenomenon notably occurs in a toner including a release agent (such as a wax) so as to prevent occurrence of a paper winding problem and an offset problem. The paper winding problem is a phenomenon in which a transfer medium having a toner image thereon is wound around a fixing member or gets stuck to a separation pick, due to adhesion of the toner image thereto. The offset problem is a phenomenon in which a part of a fused toner image is adhered and transferred to the surface of a fixing member, and then the part of the toner image is re-transferred to an undesired portion of a transfer medium. Deterioration of transferability notably occurs in toners for use in full -color image forming apparatuses.

When the fluidity of a toner decreases, the occurrence of contact with a charge giving member (such as a carrier) decreases, and therefore the toner cannot be evenly charged. As a result, background fouling tends to occur in the resultant image. In particular, this phenomenon notably occurs in a toner including a release agent (such as a wax). Background fouling is a phenomenon in which the background portion of an image is soiled with toner particles which are not sufficiently charged, at a time when an electrostatic latent image formed on a photoreceptor is developed with a toner. Deterioration of chargeability notably occurs in toners for use in full-color image forming apparatuses.

In attempting to solve these problems, published unexamined Japanese patent application No. (hereinafter referred to as JP-A) 2004-151533 discloses an image forming apparatus including a charger comprising a conductive material having an Asker C hardness of not greater than 85° and a microhardness of not greater than 85° and using a developer (i.e., a toner) having a maximum elastic compressive load of from 15 to 70 mgf. It is described therein that such an image forming apparatus has a good and stable charging property.

JP-A 2005-266383 discloses a toner having a strength of from 0.1 to 1.0 kg/mm$^2$ and a strength-displacement curve of which the ratio (kmax/kmin) of the maximum slope (kmax) to the minimum slope (kmin) is not less than 20, both determined by a micro compression testing machine. It is described therein that the abrasion amount of a cleaning blade can be reduced when such a toner is used, resulting in improving durability of the image forming apparatus used.

However, these toners tend to partially crack or transform when developed under a relatively high pressing force applied from a toner layer thickness controlling member in a one-component developing method, especially in a full-color image forming apparatus. As a result, the charge quantity of the toner changes and background fouling occurs in the resultant image.

On the other hand, in attempting to increase fluidity of a toner, toners are being modified to have a spherical shape. Since spherical toner particles easily pass through a cleaning blade when removed from the surface of a photoreceptor, the pressure of the cleaning blade needs to increase. In this case, the toner easily moves onto the surface of the photoreceptor due to the friction between the cleaning blade and the photoreceptor, resulting in the occurrence of black spots in the resultant image.

JP-A 2005-300937 discloses a spherical toner having a load-displacement curve having an inflection point, which is obtained by a micro compression test. It is described therein that such a toner has good mechanical stability, chargeability, transferability, and fixability. It is also described therein that when the inflection point appears in a load range of from 0.5 to 2 mN or the curve satisfies the following relationship through the inflection point:

$$0.1 \leqq d/P \leqq 1$$

wherein d (μm) represents the displacement and P (mN) represents the load, the toner is rapidly pressure-cracked in a fixing device and is prevented from fracturing and forming a film thereof in a developing device. Therefore, the toner has good chargeability, developability, and transferability. However, no detailed experimental result showing the relationship between the inflection point and the load is disclosed therein. Therefore, whether such a toner has the effect on the problem or not cannot be verified.

SUMMARY OF THE INVENTION

Accordingly, an object of the present invention is to provide a toner capable of fixing without application of fixing oil, and having good toner properties such as transferability and cleanability even if a relatively high pressing force is applied thereto in a one-component developing method.

Another object of the present invention is to provide an image forming method, an image forming apparatus, and a process cartridge which can produce high quality images without background fouling, hollow defect, and contamination to photoreceptor, These and other objects of the present invention, either individually or in combinations thereof, as hereinafter will become more readily apparent can be attained by a toner, comprising:

a binder resin; and a colorant, wherein the toner has a displacement—load curve in which a maximum compression strength is from 0.65 to 1.0 mN and a slope of a line through an origin point and a first shoulder is not less than 1.1 mN/μm;

and an image forming method, an image forming apparatus, and a process cartridge using the toner.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

The present invention provides a toner, comprising a binder resin and a colorant, wherein the toner has a displacement—load curve in which a maximum compression strength is from 0.65 to 1.0 mN and a slope of a line through an origin point and a first shoulder is not less than 1.1 mN/μm.

In the present invention, the compression strength of a toner is determined as follows.

Figure 1:
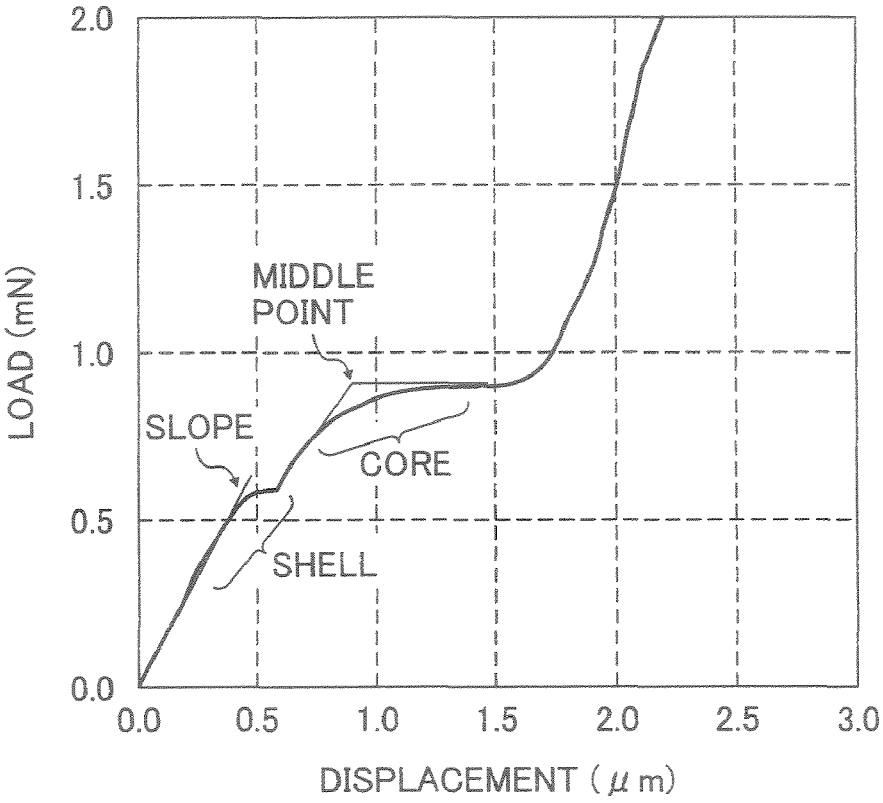
FIG. 1 is an example of a graph illustrating the relationship between the load and the displacement (i.e., load-displacement curve) of the toner of the present invention.

(1) A toner is subjected to a compression test using a dynamic ultra micro hardness tester DUH-W201S (from Shimadzu Corporation) on which a software program of a micro compression testing machine MCT-W (from Shimadzu Corporation) is mounted, to obtain a load-displacement curve as illustrated in FIG. 1, for example;

(2) Referring to the load-displacement curve illustrated in FIG. 1, a shoulder is defined as a curve section being convex upward (i.e., a section in which the second derivative $d^2y/dx^2$ satisfies the following relationship $d^2y/dx^2<0$); a shoulder starting point is defined as an inflection point at which the load-displacement curve converts from being convex downward to being convex upward (i.e., a point at which the second derivative $d^2y/dx^2$ of the curve converts from positive to negative, satisfying the following relationship $d^2y/dx^2=0$); and a shoulder end point is defined as an inflection point at which the load-displacement curve converts from being convex upward to being convex downward (i.e., a point at which the second derivative $d^2y/dx^2$ of the curve converts from negative to positive, satisfying the following relationship $d^2y/dx^2=0$).

(3) A middle point of the shoulder is defined as an intersection point of tangents to the shoulder starting point and the shoulder end point. The compression strength is defined as a value of the middle point on the load axis.

Figure 2:
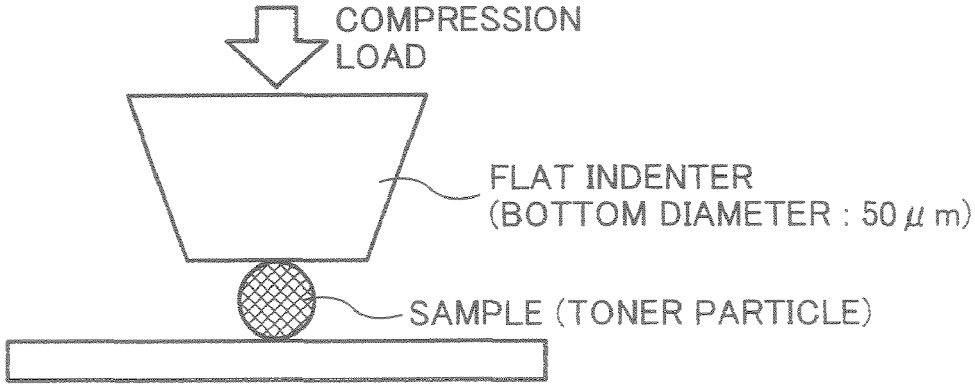
FIG. 2 is a schematic view illustrating an embodiment of the compression testing machine for use in obtaining the load-displacement curve in the present invention.

FIG. 2 is a schematic view illustrating an embodiment of the compression testing machine.

If the load-displacement curve is jagged and discontinuous due to a measurement noise, etc., the load-displacement curve should be smoothened.

As mentioned above, the shoulder is defined as a curve section being convex upward. When the rate of change of the slope dy/dx in the curve section being convex upward is less than 20%, such a curve section is not regarded as a shoulder while regarded as a measurement error.

The rate of change of the slope dy/dx is defined as the following equation:

$$(k1-k2)/k1$$

wherein each of k1 and k2 represents a slope of the tangent to the shoulder starting point and the shoulder end point, respectively, In a curve section beyond the shoulder, where the slope becomes smaller, the slope is defined as the following equation:

$$\Delta P/\Delta d$$

wherein Δd (μm) represents an increment of the displacement and ΔP (mN) represents an increment of the load.

The measurement conditions are as follows.

Test mode: Compression test

Loading rate: 0.0711 mN/sec

Indenter: FLAT50 (bottom diameter 50 μm)

Measurement environment: 23° C., 50% RH

Measurement method: Toner particles are spread on a pressure plate, and each of the toner particles is compressed.

Measurement value: Average value of 10 toner particles.

The testing machine is not limited to the above instrument so far as the compression strength can be obtained by the same principle.

The shoulder starting and end points of the load-displacement curve can be determined using a graph analysis software program capable of directly derivatizing a curve (i.e., capable of converting a curve into a linear function). In particular, the shoulder starting and end points of the load-displacement curve can be determined by first derivatizing the load-displacement curve to obtain a first derivative thereof.

In addition, the shoulder starting and end points of the load-displacement curve can also be determined by calculating slopes of line segments through 2 adjacent points constituting the load-displacement curve to obtain a graph showing the changes of the slope.

The toner of the present invention has a displacement-load curve in which the maximum compression strength is from 0.65 to 1.0 mN and a slope of a line through an origin point and a first shoulder starting point is not less than 1.1 mN/μm.

When the maximum compression strength is too small, the toner tends to partially crack or transform when developed under a relatively high pressing force (30 to 100 N/m) applied from a toner layer thickness controlling member in a one-component developing method. As a result, the charge quantity distribution of the toner broadens and background fouling occurs in the resultant image. When a toner includes a large amount of a release agent for use in an oilless fixing device, the release agent tends to be present at the surface of the toner, and thereby background fouling notably occurs in the resultant image.

When the maximum compression strength is too large, external additive particles adhered to the surface of the toner particles easily release due to the pressing force applied from the toner layer thickness controlling member, and influenced on the chargeability of the toner. In addition, when remaining toner particles on the photoreceptor are removed, the toner is rubbed with the cleaning blade and the photoreceptor. As a result, abrasion of the cleaning blade and photoreceptor tends to occur, and therefore the photoreceptor cannot be well cleaned and background fouling occurs. This phenomenon notably occurs when the toner is spherical. By controlling the displacement-load curve properties, the occurrence of background fouling can be prevented.

When the slope of a line through an origin point and a first shoulder starting point is too small, the transported amount of the toner tends to vary when developed under a relatively high pressing force (30 to 100 N/m) applied from a toner layer thickness controlling member in a one-component developing method. As a result, chargeability of the toner deteriorates and background fouling occurs in the resultant image.

When a curve section being convex upward appears from the origin point, the origin, point is regarded as the shoulder starting point and the slope of the tangent to the origin point is regarded as "a slope of a line through an origin point and a first shoulder starting point".

When a linear curve appears from an origin point and a curve section being convex upward continuously appears, a point at which the second derivative $d^2y/dx^2$ of the curve converts from 0 to negative, satisfying the following relationship $d^2y/dx^2=0$, is regarded as a first shoulder starting point.

The load-displacement curve of the toner of the present invention may have plural shoulders. For example, the load-displacement curve illustrated in FIG. 1 has 2 shoulders. In this case, the toner has a core-shell structure in which the core and shell have different compression strengths. It is considered that the shoulder having a larger displacement is obtained from the core, and the shoulder having a smaller displacement is obtained from the shell.

When a load-displacement curve of a toner has plural shoulders, the toner is prevented from cracking and transforming when developed under a relatively high pressing force applied from a toner layer thickness controlling member in a one-component developing method, because the pressing force is absorbed by the first shoulder (i.e., the shell).

The toner of the present invention includes a colored particulate material including a binder resin, a colorant, and a release agent, to which an external additive is added.

The product of the volume average particle diameter of the colored particulate material and the content of the external additive is preferably from 3 to 20 μm·% by weight. When this product is too small, transferability of the toner deteriorates, and therefore hollow defects tend to occur in the resultant image. This phenomenon notably occurs in a full-color image forming process and a toner including a release agent.

"Transferability" represents the ease with which a toner formed on the surface of a photoreceptor can be transferred onto a transfer medium. If the toner formed on the surface of a photoreceptor is transferred first onto an intermediate transfer medium and then transferred onto the transfer medium, "transferability" represents the ease with which the toner can be transferred from the photoreceptor onto the intermediate transfer medium, and that from the intermediate transfer medium onto the transfer medium.

When this product is too large, fixability of the toner deteriorates, and therefore fixing strength of the resultant image decreases. This phenomenon notably occurs in an image forming apparatus including an oilless fixing device.

As the external additive, particulate inorganic materials are preferably used. Specific examples of the particulate inorganic materials include, but are not limited to, silica, titania, alumina, strontium titanate, tin oxide, and zinc oxide. These can be used alone or in combination. From the viewpoint of improving fluidity and chargeability of the toner, silica is preferably used. The particulate inorganic material is preferably surface-treated by any known method with a typical hydrophobizing agent (e.g., a silane coupling agent, a titanate coupling agent, a silicone oil, and a silicone varnish), a fluorine-containing silane coupling agent, a fluorine-containing silicone oil, a coupling agent having an amino group or a quaternary ammonium salt group, and a modified silicone oil.

The compression strength of a toner can be controlled by varying the weight composition and molecular weight of the binder resin used.

In particular, as the larger amount of a urethane-modified or urea-modified polyester resin having a relatively high molecular weight the core of a toner includes, the larger compression strength the toner has. When the toner includes the urethane-modified or urea-modified polyester resin in an amount of from 10 to 20% by weight, the toner has an appropriate compression strength.

In addition, the larger weight average molecular weight the polyester resin has, the larger compression strength the toner has. When the toner has a weight average molecular weight of from 8,000 to 15,000, the toner has an appropriate compression strength.

The slope of a line through an origin point and a first shoulder can he controlled by varying the weight composition and molecular weight of the core. Therefore, it is much more easy to control the slope when a toner has a core- shell structure.

The toner of the present invention includes a core including a colorant, a release agent, and a binder resin (A), and a shell including a binder resin (B) covering the core. The binder resin (A) includes a polyester resin as a main component and the binder resin (B) includes a vinyl copolymer resin. The weight ratio of the core to the shell is preferably 0.05 to 0.5. The toner preferably has a volume average particle diameter of from 3 to 8 μm.

When the toner has a core-shell structure, it is noted that the shell can be a complete continuous covering about the core, or can be a partial covering (discontinuous) about the core. In the latter case, so long as the partial covering is sufficient to provide the toner with the desired properties of a complete shell, the term "shell" will include the partial covering.

Figure 3:
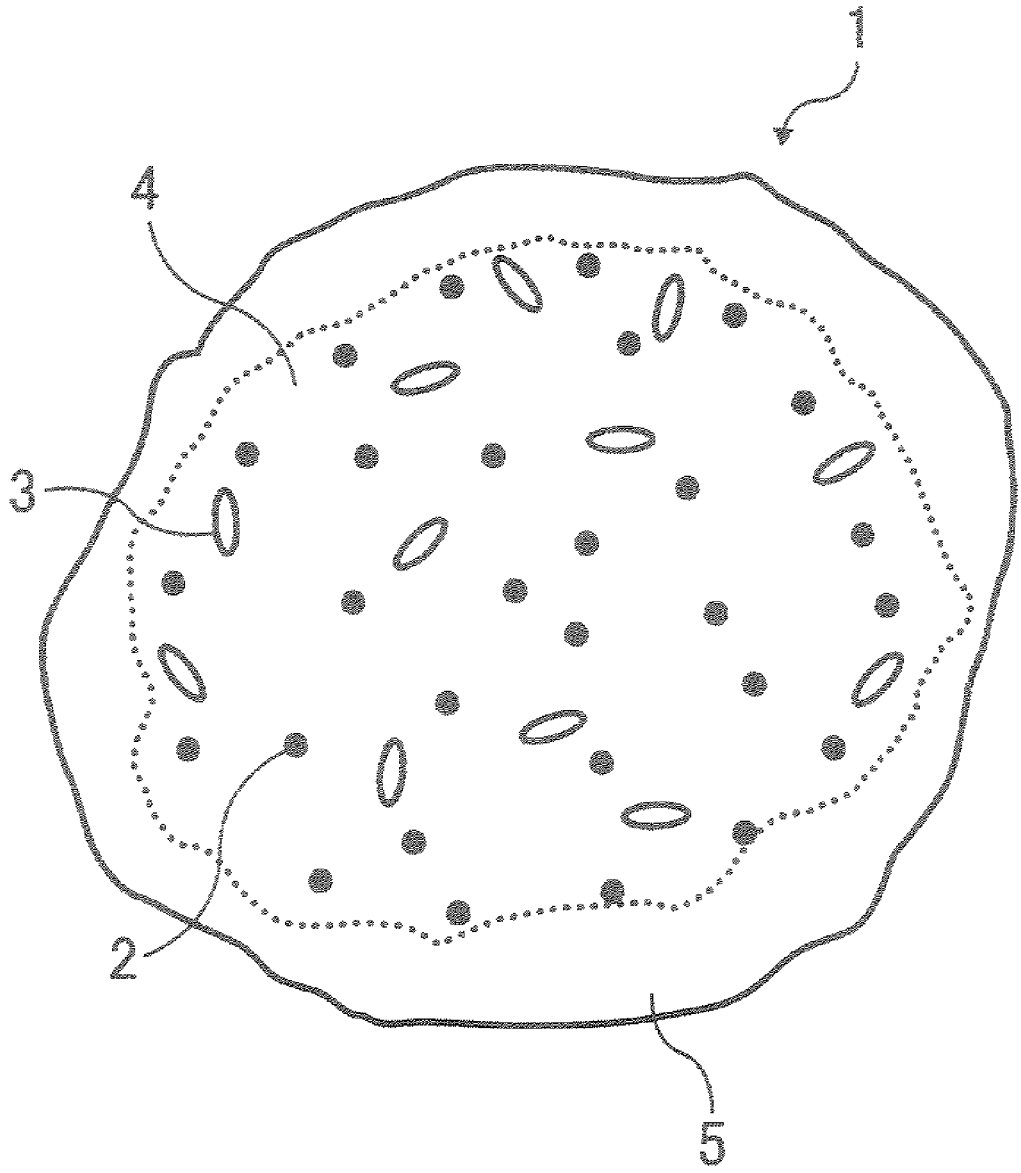
FIG. 3 is a cross-sectional view illustrating an embodiment of the toner of the present invention.

FIG. 3 is a cross-sectional view illustrating an embodiment of the toner of the present invention.

A toner 1 includes a core 4 Including a colorant 2, a release agent 3, and a binder resin (A), and a shell 5 including a binder resin (B) covering the core 4. The binder resin (A) includes a polyester resin as a main component and the binder resin (B) includes a vinyl copolymer resin. The core 4, which forms the main body of the toner, includes a polyester resin having an advantage in improving both low-temperature fixability and thermostable preservability of the toner, and the shell, which largely influences the chargeability of the toner, includes a vinyl copolymer resin having an advantage in improving chargeability of the toner.

The reasons why the vinyl copolymer resin has an advantage in controlling chargeability of the toner are as follows:

(1) Plural kinds of monomers can be polymerized. Various kinds of monomers can be used (i.e., Having high flexibility in choosing monomers). For example, polar groups (such as carboxylic acid group and sulfonic acid group) are easily introduced.

(2) A functional group originated from a monomer can be efficiently located at the surface of the resultant toner. For example, the structure of the resultant particulate polymer can be controlled by the polarity of a monomer, in emulsification polymerizations and suspension polymerizations.

For the above reason, the toner has both good fixability (i.e., low-temperature fixability) and chargeability (i.e., developability and transferability).

The weight ratio of the shell to the core is preferably 0.05 to 0.5, more preferably from 0.07 to 0.4, and much more preferably from 0.1 to 0.3. When the weight ratio is too small, the binder resin (B) cannot sufficiently exert its effect. When the weight ratio is too large, the binder resin (A) cannot sufficiently exert its effect.

The toner of the present invention preferably has a volume average particle diameter of from 3 to 8 μm, and more preferably from 4 to 7 μm. When the volume average particle diameter is too small, various problems tend to occur in image forming processes. When the volume average particle diameter is too large, resolution of the resultant image tends to deteriorate.

The toner of the present invention preferably has a softening point (Tm) of from 115 to 140° C. When the softening point is too small, the resultant toner hardly has an appropriate compression strength and the fixed image is hardly separated from a fixing member especially in an oilless fixing process. When the softening point is too large, fixability of the resultant toner deteriorates.

The toner of the present invention satisfies the following relationships:

$$RA(P)\times 0.5>RB(P) \text{ and } RA(W)\times 0.5>RB(W),$$

preferably satisfies the following relationships:

$$RA(P)\times 0.2>RB(P) \text{ and } RA(W)\times 0.2>RB(W),$$

and much more preferably satisfies the following relationships:

$$RA(P)\times 0.01>RB(P) \text{ and } RA(W)\times 0.01>RB(W),$$

wherein RA(P) represents a weight ratio of the colorant included in the core to the core, RA(W) represents a weight ratio of the release agent included in the core to the core, RB(P) represents a weight ratio of the colorant included in the shell to the shell, and RB(W) represents a weight ratio of the release agent included in the shell to the shell.

Namely, the colorant and the release agent preferably do not exist near the surface of the toner. Such a toner does not cause a formation of release agent film on image forming members such as a photoreceptor. In addition, the toner has stable chargeability and environmental resistance, and therefore the charge difference between four-color toners can be minimized.

(Polyester Resin)

As the polyester resin, any known polyester resins can be used and are not particularly limited. A mixture of plural polyester resins can also be used. Specific examples of the polyester resin include polycondensation products of a polyol (1) with a polycarboxylic acid (2).

Specific examples of the polyol (1) include, but are not limited to, alkylene glycols (e.g., ethylene glycol, 1,2-propylene glycol, 1,3-propylene glycol, 1,4-butanediol, 1,6-hexanediol), alkylene ether glycols (e.g., diethylene glycol, triethylene glycol, dipropylene glycol, polyethylene glycol, polypropylene glycol, polytetramethylene ether glycol), alicyclic diols (e.g., 1,4-cyclohexanedimethanol, hydrogenated bisphenol A), bisphenols (e.g., bisphenol A; bisphenol F; bisphenol S; 4,4'-dihydroxybiphenyls (e.g., 3,3'-difluoro-4,4'-dihydroxybiphenyl); bis(hydroxyphenyl)alkanes (e.g., bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (i.e., tetrafluoro bisphenol A), 2,2-bis(3-hydroxyphenyl)-1,1,1,3,3,3-hexafluoropropane); bis(4-hydroxyphenyl)ethers (e.g., bis(3-fluoro-4-hydroxyphenyl)ether)), adducts of the above-mentioned alicyclic diols with an alkylene oxide (e.g., ethylene oxide, propylene oxide and butylenes oxide), adducts of the above mentioned bisphenols with an alkylene oxide (e.g., ethylene oxide, propylene oxide and butylenes oxide), etc.

Among these, alkylene glycols having 2 to 12 carbon atoms and adducts of bisphenols with an alkylene oxide are preferably used, and adducts of bisphenols with an alkylene oxide and mixture thereof with alkylene glycols having 2 to 12 carbon atoms are more preferably used.

Further, multivalent aliphatic alcohols having three or more valences (e.g., glycerin, trimethylolethane, trimethylolpropane, pentaerythritol, sorbitol), phenols having three or more valences (e.g., trisphenol PA, phenol novolac, cresol novolac), and adducts of the above-mentioned phenols having three or more valences with an alkylene oxide can be used.

These polyols can be used alone or in combination.

Specific examples of the polycarboxylic acid (2) include, but are not limited to, alkylene dicarboxylic acids (e.g., succinic acid, adipic acid, sebacic acid), alkenylene dicarboxylic acids (e.g., maleic acid, fumaric acid), aromatic dicarboxylic acids (e.g., phthalic acid, isophthalic acid, terephthalic acid, naphthalene dicarboxylic acid, 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl)hexafluoropropane, 2,2-bis(3-carboxyphenyl)hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid, hexafluoroisopropylidene diphthalic anhydride), etc.

Among these, alkenylene dicarboxylic acids having 4 to 20 carbon atoms and aromatic dicarboxylic acids having 8 to 20 carbon atoms are preferably used.

Further, as polycarboxylic acids having three or more valences, aromatic polycarboxylic acids having 9 to 20 carbon atoms (e.g., trimellitic acid, pyromellitic acid) and acid anhydrides and lower alkyl ester (e.g., methyl ester, ethyl ester, isopropyl ester) thereof can be used.

These polycarboxylic acids can be used alone or in combination.

A polyol (1) and a polycarboxylic acid (2) are mixed so that the equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

The polyester resin has a peak molecular weight of from 1,000 to 30,000, preferably from 1,500 to 10,000, and more preferably from 2,000 to 8,000. When the peak molecular weight is too small, thermostable preservability of the toner deteriorates. When the peak molecular weight Is too large, low-temperature fixability of the toner deteriorates.

The polyester resin has a glass transition temperature of not less than 40° C. When the glass transition temperature is too small, thermostable preservability of the toner deteriorates.

(Vinyl Copolymer Resin)

As the vinyl copolymer resin, any known vinyl copolymer resins can be used and are not particularly limited. A mixture of plural vinyl copolymer resins can also be used.

The vinyl copolymer resin is prepared by copolymerizing vinyl monomers. Specific preferred examples of suitable vinyl monomers are shown as follows.

(1) Vinyl hydrocarbons:

aliphatic vinyl hydrocarbons such as alkenes (e.g., ethylene, propylene, butene, isobutylene, pentene, heptene, diisobutylene, octene, dodecene, octadecene, other α-olefins except the above-mentioned compounds) and alkadienes (e.g., butadiene, isoprene, 1,4-pentadiene, 1,6-hexadiene, 1,7-octadiene);

alicyclic vinyl hydrocarbons such as mono- or di-cycloalkenes and cycloalkadienes (e.g., cyclohexene, (di)cyclopentadiene, vinylcyclohexene, ethylidenebicycloheptene); and terpenes (e.g., pinene, limonene, indene); and aromatic vinyl hydrocarbons such as styrene and hydrocarbyl (alkyl, cycloalkyl, aralkyl and/or alkenyl) derivatives thereof (e.g., α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, trivinylbenzene), and vinylnaphthalene.

(2) Vinyl monomers including carboxyl group and salts thereof:

unsaturated monocarboxylic or dicarboxylic acids having 3 to 30 carbon atoms and anhydrides and monoalkyl (1 to 24 carbon-atoms) esters thereof (e.g., (meth)acrylic acid, maleic acid, maleic anhydride, monoalkyl maleate, fumaric acid, monoalkyl fumarate, crotonic acid, itaconic acid, monoalkyl itaconate, itaconic glycol monoether, citraconic acid, monoalkyl citraconate, cinnamic acid); and salts thereof.

(3) Vinyl monomers including sulfonic group and vinyl monoesters of sulfuric acid, and salts thereof:

alkene sulfonic acids having 2 to 14 carbon atoms (e.g., vinyl sulfonic acid, (meth)allyl sulfonic acid, methyl vinyl sulfonic acid, styrene sulfonic acid), and alkyl derivatives thereof having 2 to 24 carbon atoms (e.g., α-methylstyrene sulfonic acid); sulfo(hydroxy)alkyl (meth)acrylates or (meth)acrylamides (e.g., sulfopropyl (meth)acrylate, 2-hydroxy-3-(meth)acryloxypropyl sulfonic acid, 2-(meth) acryloylamino-2,2-dimethylethane sulfonic acid, 2-(meth) acryloyloxyethane sulfonic acid, 3-(meth)acryloyloxy-2-hydroxypropane sulfonic acid, 2-(meth)acrylamide-2-methylpropane sulfonic acid, 3-(meth)acrylamide-2-hydroxypropane sulfonic acid, alkyl (3 to 18 carbon atoms) allylsulfo succinic acid, sulfuric acid ester of poly(n is 2 to 30) oxyalkylene (ethylene, propylene, butylene and mono, random and block copolymers thereof) mono(meth)acrylate such as sulfuric acid ester of poly (n is 5 to 15) oxypropylene monomethacrylate, sulfuric acid esters of polyoxyethylene polycyclic phenylether); and salts thereof.

(4) Vinyl monomers including phosphate group and salts thereof:

(meth)acryloyloxyalkyl phosphoric acid monoesters (e.g., 2-hydroxyethyl(meth)acryloyl phosphate, phenyl-2-acryloyloxyethyl phosphate);

(meth)acryloyloxyalkyl (1 to 24 carbon atoms) phosphonic acids (e.g., 2-acryloyloxyethyl phosphonic acid); and salts thereof.

Specific examples of the above-mentioned salts of monomers shown in the above paragraphs (2) to (4) include alkali metal salts (e.g., sodium salts, potassium salts), alkaline-earth metal salts (e.g., calcium salts, magnesium salts), ammonium salts, amine salts and quaternary ammonium salts.

(5) Vinyl monomers including hydroxyl group:

hydroxystyrene, N-methylol (meth)acrylamide, hydroxyethyl (meth)acrylate, hydroxypropyl (meth)acrylate, polyethyleneglycol mono(meth)acrylate, (meth)allylalcohol, crotyl alcohol, isocrotyl alcohol, 1-butene-3-ol, 2-butene-1-ol, 2-butene-1,4-diol, propargyl alcohol, 2- hydroxyethyl property 1 ether, and sucrose allyl ether.

(6) Vinyl monomers including nitrogen;

vinyl monomers including amino group (e.g., aminoethyl (meth)acrylate, dimethylaminoethyl (meth)acrylate, diethylaminoethyl (meth)acrylate, t-butylaminoethyl (meth)acrylate, N-aminoethyl(meth)acrylamide, (meth) acrylamine, morpholinoethyl (meth)acrylate, 4-vinylpyridine, 2-vinylpyridine, crotylamine, N,N-dimethylaminostyrene, methyl-α-acetoamino acrylate, vinylimidazole, N-vinylpyrrol, N-vinylthiopyrrolidone, N-arylphenylenediamine, aminocarbazole, aminothiazole, aminoindole, aminopyrrol, aminoimidazole, aminomercaptothiazole, and salts thereof);

vinyl monomers including amide group (e.g., (meth)acrylamide, N-methyl(meth)acrylamide, N-butylacrylamide, diacetoneacrylamide, N-methylol(meth)acrylamide, N,N-methylene-bis(meth)acrylamide, cinammic acid amide, N,N-dimethylacrylamide, N,N-dibenzylacrylamide, methacrylformamide, N-methyl-N-vinylacetamide, N-vinylpyrrolidone);

vinyl monomers including nitrile group (e.g., (meth)acrylonitrile, cyanostyrene, cyanoacrylate);

vinyl monomers including quaternary ammoniumcation group such as quaternary compounds of vinyl monomers (e.g., dimethylaminoethyl(meth)acrylate, diethylaminoethyl (meth)acrylate, dimethylaminoethyl (meth)acrylamide, diethylaminoethyl (meth)acrylamide, diallylamine) including tertiary amine group produced by using quaternate agent (e.g., methyl chloride, dimethyl sulfonic acid, benzyl chloride, dimethyl carbonate); and vinyl monomers including nitro group (e.g., Nitrostyrene).

(7) Vinyl monomers including epoxy group:

glycidyl (meth)acrylate, tetrahydrofurfuryl (meth)acrylate, and p-vinylphenylphenyloxide.

(8) Vinylesters, vinyl(thio)ethers, vinylketones, vinylsulfones:

vinylesters (e.g., vinyl acetate, vinyl butyrate, vinyl propionate, diallyl phthalate, diallyl adipate, isopropenyl acetate, vinyl methacrylate, methyl-4-vinyl benzoate, cyclohexyl methacrylate, benzyl methacrylate, phenyl (meth)acrylate, vinylmethoxy acetate, vinyl benzoate, ethyl-α-ethoxy acrylate, alkyl (meth)acrylates including alkyl group having 1 to 50 carbon atoms (such as methyl (meth)acrylate, ethyl (meth)acrylate, propyl (meth)acrylate, butyl (meth)acrylate, 2-ethylhexyl (meth)acrylate, dodecyl (meth)acrylate, hexadecyl (meth)acrylate, heptadecyl (meth)acrylate, and eicocyl (meth)acrylate), dialkyl fumarates (2 alkyl groups have 2 to 8 carbon atoms and have straight-chain, branched-chain or alicyclic structure), dialkyl maleates (2 alkyl groups have 2 to 8 carbon atoms and have straight-chain, branched-chain or alicyclic structure), poly(meth)allyloxyalkanes (such as diallyloxyethane, triallyloxyethane, tetraallyloxyethane, tetraallyloxypropane, tetraallyloxybutane, and tetramethallyloxyethane), vinyl monomers including polyalkyleneglycol chain (such as polyethyleneglycol (molecular weight of 300) mono (meth)acrylate, polypropyleneglycol(molecular weight of 500) monoacrylate, adduct of methy alcohol (meth)acrylate with 10 mols of ethyleneoxide, and adduct of lauryl alcohol (meth)acrylate with 30 mols of ethyleneoxide), and poly(meth)acrylates ((meth)acrylates of polyalcohols such as ethyleneglycol di(meth)acrylate, propyleneglycol di(meth)acrylate, neopentylglycol di(meth)acrylate, trimethylolpropane tri (meth)acrylate, and polyethyleneglycol di(meth)acrylate));

vinyl(thio)ethers (e.g., vinylmethylether, vinylethylether, vinylpropylether, vinylbutylether, vinyl-2-ethylhexyiether, vinylphenylether, vinyl-2-methoxyethylether, methoxybutadiene, vinyl-2-butoxyethylether, 3,4-dihydro-1,2-pyran, 2-butoxy-2'-vinyloxydiethylether, vinyl-2-ethylmercaptoethylether, acetoxystyrene, phenoxystyrene);

vinylketones (e.g., vinyl methyl ketone, vinyl ethyl ketone, vinyl phenyl ketone); and vinylsulfones (e.g., divinylsulfide, p-vinyldiphenylsulfide, vinylethylsulfide, vinylethylsulufone, divinylsulfone, divinylsulfoxide).

(9) Another vinyl monomers:

isocyanatoethyl (meth)acrylate and m-isopropenyl-α,α-dimethylbenzylisocyanate.

(10) Vinyl monomers including fluorine:

4-fluorostyrene, 2,3,5,6-tetrafluorostyrene, pentafluorophenyl (meth)acrylate, pentafluorobenzyl (meth)acrylate, perfluorohexyl (meth)acrylate, perfluorocyclohexylmethyl (meth)acrylate, 2,2,2-trifluoroethyl (meth)acrylate, 2,2,3,3-tetrafluoropropyl (meth)acrylate, 1H,1H,4H-hexafluorobutyl (meth)acrylate, 1H,1H,5H-octafluoropentyl (meta)acrylate, 1H,1H,7H-dodecafluoroheptyl (meth) acrylate, perfluorooctyl (meth)acrylate, 2-perfluorooctylethyl (meth)acrylate, heptadecafuluorodecyl (meth)acrylate, trihydroperfluoroundecyl (meth)acrylate, perfluoronorbornylmethyl (meth)acrylate, 1H-perfluoroisobornyl (meth)acrylate, 2-(N-butylperfluorooctanesulfoneamide)ethyl (meth)acrylate, 2-(N-ethylperfluorooctanesulfoneamide)ethyl (meth)acrylate, derivatives of α-fluoroacrylic acid;

bis-hexafluoroisopropyl itaconate, bis-hexafluoroisopropy1 maleate, bis-perfluorooctyl itaconate, bis-perfluorooctyl maleate, bis-trifluoroethyl itaconate, bis-trifluoroethyl maleate; and vinylheptafluoro butyrate, vinylperfluoro heptanoate, vinylperfluoro nonanoate, and vinylperfluoro octanoate.

Specific examples of the vinyl copolymer resin include copolymers of two or more vinyl monomers shown in the above paragraphs (1) to (10) at any mixing ratio such as styrene-(meth)acrylate copolymer, styrene-butadiene copolymer, (meth)acrylic acid-acrylate copolymer, styrene-acrylonitrile copolymer, styrene-maleic anhydride copolymer, styrene-(meth)acrylic acid copolymer, styrene-(meth) acrylic acid-divinylbenzene copolymer, and styrene-styrene sulfonic acid-(meth)acrylate copolymer.

When the toner is prepared, an aqueous dispersion of the vinyl copolymer resin is preferably used. Such a dispersion can be prepared by typical emulsion polymerization, etc.

The binder resin (B) is preferably formed by aggregating and/or fusing particles of vinyl copolymer resin. When the shell is formed of aggregated particles of the vinyl copolymer resin, the core is completely covered therewith. When the shell is formed of fused particles of the vinyl copolymer resin, the core is much more completely covered therewith. As a result, the resultant toner has a smooth and even surface, and therefore the toner has stable charge quantity distribution and good transferability.

(Modified Polyester Resin)

The binder resin (A) may include a polyester resin elongated by a urethane and/or urea bond (hereinafter referred to as a modified polyester resin having a urethane and/or urea bond). The binder resin (A) preferably includes the modified polyester resin having a urethane and/or urea bond in an amount of not larger than 20% by weight. When the amount is too large, low-temperature fixability of the toner deteriorates. When the amount is too small, compression strength of the toner deteriorates. The modified polyester resin having a urethane and/or urea bond can be directly mixed with the binder resin (A). However, in terms of manufacturability, the modified polyester resin is preferably prepared by mixing and reacting (i.e., elongating and/or cross-linking) a prepolymer having an isocyanate group at its end with an amine capable of reacting with the prepolymer so that the modified polyester resin having a urethane and/or urea bond is prepared when or after the toner is granulated. In this case, the modified polyester resin can be easily included in the core region.

The prepolymer having an isocyanate group is formed by a reaction between a poly isocyanate (3) and a polyester having an active hydrogen group which is formed by the polycondensation reaction between the polyol (1) and the polycarboxylic acid (2). Specific examples of the active hydrogen group included in the polyester include, but are not limited to, hydroxyl group (alcoholic hydroxyl group and phenolic hydroxyl group), amino group, carboxyl group, mercapto group, etc. Among these, alcoholic hydroxyl group is preferably selected.

Specific examples of the poly isocyanate (3) include, but are not limited to, aliphatic polyisocyanates (e.g., tetramethylenediisocyanate, hexamethylenediisocyanate, 2,6-diisocyanatemethylcaproate); alicyclic polyisocyanates (e.g., isophoronediisocyanate, cyclohexylmethanediisocyanate); aromatic diisocyanates (e.g., tolylenediisocyanate, diphenylmethanediisocyanate); aromatic aliphatic diisocyanates (α,α,α',α',-tetramethylxylylenediisocyanate); isocyanurates; the above-mentioned polyisocyanates blocked with phenol derivatives, oxime and caprolactam; and their combinations. These can be used alone or in combination.

A polyisocyanate (3) is mixed with a polyester such that the equivalent ratio ( [NCO]/[OH]) between an isocyanate group [NCO] and a hydroxyl group [OH] included in the polyester is typically from 5/1 to 1/1, preferably from 4/1 to 1.2/1, and more preferably from 2.5/1 to 1.5/1. When the ratio [NCO]/[OH] is too large, low-temperature fixability of the resultant toner deteriorates. When the ratio [NCO]/[OH] is too small, the urea content in the resultant modified polyester resin decreases and hot offset resistance of the resultant toner deteriorates.

The content of the constitutional unit obtained from a polyisocyanate (3) in the prepolymer is from 0.5 to 40% by weight, preferably from 1 to 30% by weight, and more preferably from 2 to 20% by weight. When the content is too small, hot offset resistance of the resultant toner deteriorates. In contrast, when the content is too large, low-temperature fixability of the resultant toner deteriorates.

The number of the isocyanate groups included in a molecule of the polyester prepolymer is at least 1, preferably from 1.5 to 3 on average, and more preferably from 1.8 to 2.5 on average. When the number of isocyanate groups is less than 1 per molecule, the molecular weight of the modified polyester after an elongation and/or a crosslinking reaction decreases and the hot offset resistance of the resultant toner deteriorates.

As the elongation and/or crosslinking agent, amines are preferably used.

Specific examples of the amines include, but are not limited to, diamines, polyamines having three or more amino groups, amino alcohols, amino mercaptans, amino acids, and blocked amines in which the amino groups in these amines are blocked.

Specific examples of the diamines include, but are not limited to, aromatic diamines (e.g., phenylene diamine, diethyltoluene diamine, 4,4'-diaminodiphenyl methane, tetrafluoro-p-xylylene diamine, tetrafluoro-p-phenylene diamine), alicyclic diamines (e.g., 4,4'-diamino-3,3'-dimethyldicyclohexyl methane, diaminocyclohexane isophoronediamine), and aliphatic diamines (e.g., ethylene diamine, tetrametylene diamine, hexamethylene diamine, dodecafluorohexylene diamine, tetracosafluorododecylene diamine).

Specific examples of the polyamines having three or more amino groups include, but are not limited to, diethylene triamine and triethylene tetramine.

Specific examples of the amino alcohols include, but are not limited to, ethanolamine and hydroxyethyl aniline.

Specific examples of the amino mercaptan include, but are not limited to, aminoethyl mercaptan and aminopropyl mercaptan.

Specific examples of the amino acids include, but are not limited to, amino propionic acid and amino caproic acid.

Specific examples of the blocked amines include, but are not limited to, ketimine compounds which are prepared by reacting one of the above-mentioned amines with a ketone (e.g., acetone, methyl ethyl ketone, methyl isobutyl ketone), oxazoline compounds, etc.

The molecular weight of the modified polyester resin can optionally be controlled using a reaction stopping agent which stops an elongation and/or cross-linking reaction, if desired. Specific examples of the reaction stopping agent include, but are not limited to, monoamines (e.g., diethyl amine, dibutyl amine, butyl amine, lauryl amine), blocked amines (i.e., ketimine compounds prepared by blocking the monoamines mentioned above), etc.

The mixing ratio (i.e., a ratio [NCO]/[NHx]) of the content of the prepolymer having an isocyanate group to the amine is from 1/2 to 2/1, preferably from 1/1.5 to 1.5/1, and more preferably from 1/1.2 to 1.2/1. When the mixing ratio is too large or too small, the molecular weight of the modified polyester resin decreases, resulting in deterioration of hot offset resistance of the resultant toner.

(Colorant)

Specific examples of the colorants for use in the toner of the present invention include any known dyes and pigments such as carbon black, Nigrosine dyes, black iron oxide, NAPHTHOL YELLOWS, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroani1ine red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These materials can be used alone or in combination. The toner preferably includes a colorant in an amount of from 1 to 15% by weight, and more preferably from 3 to 10% by weight.

The colorant for use in the present invention can be combined with a resin to be used as a master batch. Specific examples of the resin for use in the master batch include, but are not limited to, the above-mentioned polyester-based resins, styrene polymers and substituted styrene polymers (e.g., polystyrenes, poly-p-chlorostyrenes, polyvinyltoluenes), styrene copolymers (e.g., styrene-p-chlorostyrene copolymers, styrene-propylene copolymers, styrene-vinyl toluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylatecopolymers, styrene-butylmethacrylatecopolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers), polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic acids, rosins, modified rosins, terpene resins, aliphatic or alicyclic hydrocarbon resins, aromatic petroleum resins, chlorinated paraffins, paraffin waxes, etc. These resins can be used alone or in combination.

The master batches can be prepared by mixing one or more of the resins as mentioned above and the colorant as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed, can be preferably used because the resultant wet cake can be used as it is without being dried. When performing the mixing and kneading process, dispersing devices capable of applying a high shearing force such as three roll mills can be preferably used.

(Release Agent)

Any known release agents can be used for the toner of the present invention. Specific examples of the release agents include, but are not limited to, polyolefin waxes (e.g., polyethylene waxes, polypropylene waxes), hydrocarbons having a long chain (e.g., paraffin waxes, SASOL waxes), and waxes having a carbonyl group. Specific examples of the waxes having a carbonyl group include, but are not limited to, esters of polyalkanoic acids (e.g., carnauba waxes, montan waxes, trimethylolpropane tribehenate, pentaerythritol tetrabehenate, pentaerythritol diacetate dibehenate, glycerin tribehenate, 1,18-octadecanediol distearate); polyalkanol esters (e.g., tristearyl trimellitate, distearyl maleate); polyalkanoic acid amides (e.g., ethylenediamine dibehenyl amide); polyalkylamides (e.g., trimellitic acid tristearylamide); and dialkyl ketones (e.g., distearyl ketone). Among these waxes having a carbonyl group, polyalkanoic acid esters are preferably used.

The toner preferably includes the release agent in an amount of from 3 to 15% by weight. When the amount is too small, the wax cannot sufficiently exert its effect, and therefore hot offset easily occurs. When the amount is too large, the wax, which melts at low temperatures, tends to exude from the toner due to the application of thermal and mechanical energies to the toner when agitated in a developing device, and contaminate a toner layer controlling member and a photoreceptor, etc., resulting in causing noise in the resultant image.

When the wax is subjected to a temperature rising scan of a differential scanning calorimeter (DSC), an endothermic peak is preferably observed in a temperature range of from 65 to 115° C. When the temperature is too small, fluidity of the toner deteriorates. When the temperature is too large, fixability of the toner deteriorates.

(Charge Controlling Agent)

The toner of the present invention may optionally include a charge controlling agent.

Specific examples of the charge controlling agent include any known charge controlling agents such as Nigrosine dyes, triphenylmethane dyes, metal complex dyes including chromium, chelate compounds of molybolic acid, Rhodamine dyes, alkoxyamines, quaternary ammonium salts (including fluorine-modified quaternary ammonium salts), alkyl amides, phosphor and compounds including phosphor, tungsten and compounds including tungsten, fluorine-containing activators, metal salts of salicylic acid, and salicylic acid derivatives, but are not limited thereto, Specific examples of commercially available charge controlling agents include, but are not limited to, BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd,; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

(External Additive)

In order to prepare a toner having good fluidity, developability, and chargeability, particulate inorganic materials are preferably added to a colored particulate material as an external additive.

The particulate inorganic material preferably has a primary particle diameter of from 5 nm to 2 μm, and more preferably from 5 to 500 nm. The particulate inorganic material preferably has a BET specific surface area of from 20 to 500 $m^2/g$.

The toner preferably includes the particulate inorganic material in an amount of from 0.01 to 5.0% by weight, and more preferably from 0.01 to 2.0% by weight, based on total weight of the toner.

Specific examples of the particulate inorganic materials include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, combined oxides such as silicon oxide/magnesium oxide and silicon oxide/aluminum oxide, zirconium oxide, barium sulfate, barium carbonate, calcium carbonate, silicon carbide, silicon nitride, etc.

Particles of a polymer selected from polystyrenes, polymethacrylates, and polyacrylate copolymers, which are prepared by a polymerization method selected from soap-free emulsion polymerization methods, suspension polymerization methods and dispersion polymerization methods; particles of a polymer such as silicone, benzoguanamine and nylon, which are prepared by a polymerization method such as polycondensation methods; and particles of a thermosetting resin can also be used as the external additive of the toner of the present invention.

The above external additives are preferably surface-treated to improve the hydrophobicity thereof. Such a surface-treated external additive can prevent deterioration of fluidity and chargeability of the toner even under high humidity conditions. Specific examples of surface treatment agents include, but are not limited to, silane coupling agents, silylation agents, silane coupling agents having a fluorinated alkyl group, organic titanate coupling agents, aluminum coupling agents, silicone oils, modified silicone oils, etc.

(Cleanability Improving Agent)

A cleanability improving agent can be added to the toner so as to remove toner particles remaining on the surface of a photoreceptor or a primary transfer medium after a toner image is transferred. Specific examples of the cleanability improving agents include, but are not limited to, fatty acids and metal salts thereof such as stearic acid, zinc stearate, and calcium stearate; and particulate polymers such as polymethyl methacrylate and polystyrene, which are manufactured by a method such as soap-free emulsion polymerization methods. Particulate resins having a relatively narrow particle diameter distribution and a volume average particle diameter of from 0.01 to 1 μm are preferably used as the cleanability improving agent.

(Method for Preparing Toner)

Next, the method of preparing the toner of the present invention will be explained. The toner is preferably prepared by the following method, but is not limited thereto.

The toner of the present invention is preferably prepared by a method including;

dissolving or dispersing core constituents including a polyester resin, a colorant, and a release agent in an organic solvent to prepare a core constituent mixture liquid;

dispersing the core constituent mixture liquid in an aqueous medium to prepare a first dispersion containing core particles; and adding a second dispersion containing a particulate vinyl copolymer resin to the first dispersion to adhere the particulate vinyl copolymer resin to the core particles.

The organic solvent used for dissolving or dispersing core constituents preferably has a Hansen solubility parameter (described in POLYMER HANDBOOK $4^{th}$ Edition, WILEY-INTERSCIENCE Volume 2, Section VII) of not greater than 19.5. In addition, volatile solvents having a boiling point of lower than 100° C. are preferably used so as to be easily removed after the granulating process.

Specific examples of the volatile solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, ester solvents such as methyl acetate and ethyl acetate, aromatic solvents such as toluene and xylene, and halogenated hydrocarbons such as methylene chloride, 1,2-dichloroethane, chloroform and carbon tetrachloride are preferably used. Each of the toner constituents can be dissolved or dispersed simultaneously, however, these are dissolved or dispersed respectively in general. The solvent used in the respective dissolution or dispersion liquid can be same or different, but it is preferable to use the same solvent in each dissolution or dispersion liquid so as to be easily removed.

The dissolution or dispersion liquid of the polyester resin preferably has a resin content of from 40 to 80%. When the resin content is too high, dissolution or dispersion cannot be well performed because of high viscosity of the liquid. When the resin content is too low, manufacturability of the toner deteriorates.

When the prepolymer (i.e., a modified polyester having an isocyanate group at its end) is mixed with the polyester resin, the prepolymer can be dissolved or dispersed together with the polyester resin in the same liquid, or separately in the different liquids. However, it is preferable that the prepolymer and the polyester resin are dissolved or dispersed separately in the different liquids because solubility and viscosity of each material is different.

The colorant can be dissolved or dispersed in the solvent alone, or with the polyester resin or the prepolymer, optionally with a dispersibility improving agent and another polyester resin. In addition, the master batch of the colorant mentioned above can be used.

When an organic solvent in which the release agent is not dissolved is used, a dispersion of the release agent can be prepared by typical methods. Namely, the mixture of the organic solvent and the release agent is subjected to a dispersion treatment using a bead mill. In this case, it is preferable that the mixture is once heated to the melting point of the release agent followed by cooling with agitation, before being subjected to the dispersion treatment using a bead mill. This is because the dispersion time can be shortened. The release agent can be used alone or in combination, and optionally mixed with a dispersibility improving agent and another polyester resin.

Suitable aqueous media used for preparing core particles include water. In addition, other solvents which can be mixed with water can be added to water. Further, a saturated amount of the above-mentioned solvents having a Hansen solubility parameter of not greater than 19.5 can also be added to water. In this case, the emulsification or dispersion can be stabilized.

Specific examples of such solvents include, but are not limited to, alcohols (e.g., methanol, isopropanol, ethylene glycol),dimethylformamide,tetrahydrofuran, cellosolves (e.g., methyl cellosolve), and lower ketones (e.g., acetone, methyl ethyl ketone).

The content of the aqueous medium to 100 parts by weight of the toner constituent mixture liquid is typically from 50 to 2,000 parts by weight, and preferably from 100 to 1,000 parts by weight. When the content is too small, the toner constituents tend not to be well dispersed, and thereby a toner having a desired particle diameter cannot be prepared. In contrast, when the content is too large, the production costs increase.

The aqueous medium preferably includes a dispersion stabilizer such as an inorganic dispersant and a particulate resin. In this case, the resultant particles have a sharp particle diameter distribution and good dispersion stability.

Specific examples of the inorganic dispersants include, but are not limited to, tricalciumphosphate, calcium carbonate, titanium oxide, colloidal silica, and hydroxyapatite.

Any resins capable of forming an aqueous dispersion thereof can be used for the particulate resin, whether the resin is thermoplastic resin or thermosetting resin. Specific examples of resins used for the particulate resins include, but are not limited to, vinyl resins, polyurethane resins, epoxy resins, polyester resins, polyamide resins, polyimide resins, silicon resins, phenol resins, melamine resins, urea resins, aniline resins, ionomer resins, and polycarbonate resins. These resins can be used alone or in combination. Among these resins, vinyl resins, polyurethane resins, epoxy resins, and polyester resins are preferably used because these resins can easily form aqueous dispersions of the particulate resins thereof.

Suitable methods for forming an aqueous dispersion of the particulate resin are as follows, but are not limited thereto:

(a) When the resin is a vinyl resin, an aqueous dispersion of a particulate resin is directly formed by polymerization reaction (such as suspension polymerization, emulsion polymerization, seed polymerization, and dispersion polymerization) of monomers in an aqueous medium.

(b) When the resin is a polyaddition resin or a polycondensation resin such as polyester resin, polyurethane resin, and epoxy resin, a precursor of the resin (such as monomer and oligomer) or a solvent solution of the precursor is dispersed in an aqueous medium in the presence of a suitable dispersing agent, followed by heating or adding a curing agent so that an aqueous dispersion of a particulate resin is formed.

(c) When the resin is a polyaddition resin or a polycondensation resin such as polyester resin, polyurethane resin, and epoxy resin, a precursor of the resin (such as monomer and oligomer, preferably in liquid form, if not liquid, preferably liquefied by the application of heat) or a solvent solution of the precursor is phase-inversion emulsified by adding an aqueous medium after adding a suitable emulsifying agent thereto so that an aqueous dispersion of a particulate resin is formed.

(d) A resin formed by polymerization reaction (such as addition polymerization, ring-opening polymerization, condensation polymerization, and addition condensation) is pulverized using a mechanical rotational type pulverizer or a jet type pulverizer, followed by classification, to prepare a particulate resin. The particulate resin is dispersed in an aqueous medium in the presence of a suitable dispersing agent so that an aqueous dispersion of the particulate resin is formed.

(e) A resin formed by polymerization reaction (such as addition polymerization, ring-opening polymerization, condensation polymerization, and addition condensation) is dissolved in a solvent, and then the resin solution is sprayed in the air to prepare a particulate resin. The particulate resin is dispersed in an aqueous medium in the presence of a suitable dispersing agent so that an aqueous dispersion of the particulate resin is formed.

(f) A resin formed by polymerization reaction (such as addition polymerization, ring-opening polymerization, condensation polymerization, and addition condensation) Is dissolved in a solvent to prepare a resin solution. Another solvent is added to the resin solution or the resin solution is subjected to cooling after heating, and then the solvent is removed so that a particulate resin separates out. The particulate resin is dispersed in an aqueous medium in the presence of a suitable dispersing agent so that an aqueous dispersion of the particulate resin is formed.

(g) A resin formed by polymerization react ion (such as addition polymerization, ring-opening polymerization, condensation polymerization, and addition condensation) is dissolved in a solvent, and then the resin solution is dispersed in an aqueous medium in the presence of a suitable dispersing agent, followed by removal of the solvent, so that an aqueous dispersion of a particulate resin Is formed.

(h) A resin formed by polymerization react ion (such as addition polymerization, ring-opening polymerization, condensation polymerization, and addition condensation) is dissolved in a solvent, and then the resin solution is phase-inversion emulsified by adding an aqueous medium after adding a suitable emulsifying agent thereto so that an aqueous dispersion of a particulate resin is formed.

When the toner constituent mixture liquid is emulsified and dispersed in an aqueous medium, surfactants are preferably used.

Specific examples of the surfactants include, but are not limited to, anionic surfactants such as alkylbenzene sulfonic acid salts, α-olefin sulfonic acid salts and phosphoric acid salts; cationic surfactants such as amine salts (e.g., alkyl amine salts, aminoalcohol fatty acid derivatives, polyamine fatty acid derivatives, imidazoline) and quaternary ammonium salts (e.g., alkyltrimethyl ammonium salts, dialkyldimethyl ammonium salts, alkyl dimethyl benzyl ammonium salts, pyridinium salts, alkyl isoquinolinium salts, benzethonium chloride); nonionic surfactants such as fatty acid amine derivatives and polyhydric alcohol derivatives; and ampholytic surfactants such as aniline, dodecyldi(aminoethyl)glycin, di(octylaminoethyl)glycin, and N-alkyl-N,N-dimethylammonium betaine.

By using a fluorine-containing surfactant as the surfactant, good charging properties and good charge rising property can be imparted to the resultant toner. Specific examples of anionic surfactants having a fluoroalkyl group include, but are not limited to, fluoroalkyl carboxylic acids having from 2 to 10 carbon atoms and metal salts thereof, disodium perfluorooctanesulfonylglutamate, sodium 3-{ω-fluoroalkyl (C6-C11) oxy}-1-alkyl (C3-C4) sulfonate, sodium 3-{ω-fluoroalkanoyl (C6-C8)-N-ethylamino}-1-propanesulfonate, fluoroalkyl (C11-C20) carboxylic acids and metal salts thereof, perfluoroalkyl (C7-C13) carboxylic acids and metal salts thereof , perfluoroalkyl(C4-C12) sulfonate and metal salts thereof, perfluorooctanesulfonic acid diethanol amides, N-propyl-N-(2-hydroxyethyl)perfluorooctanesulfone amide, perfluoroalkyl (C6-C10) sulfoneamidepropyltrimethyl ammonium salts, salts of perfluoroalkyl (C6-C10)-N-ethylsulfonylglycin, and monoperfluoroalkyl (C6-C16) ethylphosphates. Specific examples of the cationic surfactants having a fluoroalkyl group include, but are not limited to, primary, secondary, and tertiary aliphatic amines having a fluoroalkyl group, aliphatic quaternary salts such as perfluoroalkyl (C6-C10) sulfoneamidepropyltrimethylammonium salts, benzalkonium salts, benzetonium chloride, pyridinium salts, and imidazolinium salts.

Further, it is possible to stably disperse the toner constituent mixture liquid in an aqueous liquid using a polymeric protection colloid. Specific examples of such protection colloids include, but are not limited to, polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid, maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide, N-methyloimethacrylamide), vinyl alcohols and ethers thereof (e.g., vinyl methyl ether, vinyl ethyl ether, vinyl propyl ether), and esters of vinyl alcohols with a compound having a carboxyl group (e.g., vinyl acetate, vinyl propionate, vinyl butyrate); acrylic amides (e.g., acrylamide, methacrylamide, diacetoneacrylamide) and methylol compounds thereof, acid chlorides (e.g., acrylic acid chloride, methacrylic acid chloride), and monomers having a nitrogen atom or an alicyclic ring having a nitrogen atom (e.g., vinyl pyridine, vinyl pyrrolidone, vinyl imidazole, ethylene imine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, polyoxyethylene nonylphenyl esters); and cellulose compounds such as methyl cellulose, hydroxyethyl cellulose and hydroxypropyl cellulose, can also be used as the polymeric protective colloid.

When a dispersant such as calcium phosphate which can be dissolved in an acid or an alkali is used, the particles are preferably washed by a method in which the particles are washed with an acid such as hydrochloric acid to dissolve the dispersant, and then washed with water. In addition, such dispersants can also be removed from the resultant particles by a method using an enzyme. The dispersants can remain on the surface of the particles, however, it is preferable to remove them so that the resultant toner has a good chargeability.

As the dispersing machine, known mixers and dispersing machines such as low shearing force type dispersing machines, high shearing force type dispersing machines, friction type dispersing machines, high pressure jet type dispersing machines, and ultrasonic dispersing machine can be used. In order to prepare a dispersion including particles having an average particle diameter of from 2 to 20 μm, high shearing force type dispersing machines are preferably used. When high shearing force type dispersing machines are used, the rotation speed of rotors is not particularly limited, but the rotation speed is generally from 1,000 to 30,000 rpm and preferably from 5,000 to 20,000 rpm. The temperature in the dispersing process is generally 0 to 150° C. (under pressure), and preferably from 20 to 80° C.

In order to remove the organic solvent from the thus prepared emulsion, any known removing methods can be used. For example, a method in which the emulsion is gradually heated under normal pressure or reduced pressure to completely evaporate the organic solvent in the drops of the oil phase can be used.

Next, the process in which a particulate vinyl copolymer resin is adhered to core particles including toner constituents (hereinafter referred to the adherence process) will be explained. The particulate vinyl copolymer resin is preferably used as an aqueous dispersion thereof. The aqueous dispersion of the particulate vinyl copolymer resin can be easily prepared by typical emulsion polymerization methods and the resultant dispersion can be used for the adherence process without any treatment. The aqueous dispersion of the particulate vinyl copolymer resin can optionally include a surfactant in order to stably disperse the core particles and the particulate vinyl copolymer resin. The aqueous dispersion of the particulate vinyl copolymer resin is preferably added to the dispersion of the core particles after the organic solvent is removed therefrom.

In the adherence process, the pH of the dispersion can be controlled by adding sodium hydride or hydrochloric acid, in order to efficiently adhere the particulate resin to the core particles.

As an aggregation agent, metal salts comprising metals having 1 to 3 valences can be used. Specific examples of the monovalent metals include, but are not limited to, lithium, potassium, and sodium. Specific examples of the divalent metals include, but are not limited to, calcium and magnesium. Specific examples of the trivalent metals include, but are not limited to, aluminum. Specific examples of anionic ions comprised in the salts include, but are not limited to, chloride ion, bromide ion, iodide ion, carbonate ion, and sulfate ion. The adherence can be accelerated by the application of heat. The heating temperature can be either above or below the glass transition temperature (Tg) of the particulate vinyl copolymer resin. However, when the adherence process is performed at a temperature around or below the Tg, there may be cases where the particulate vinyl copolymer resin does not well aggregate and/or fuse. Therefore, in this case, the adherence process may preferably be performed again at higher temperature in order to accelerate aggregation and fusion of the particle vinyl copolymer resin so that the particulate vinyl copolymer resin sufficiently covers the core particles and the surface of the shell is made uniform. However, the uniformity of the surface and the circularity of the toner particles are controlled by controlling the heating temperature and the heating time.

In order that the resultant toner may include a modified polyester resin having a urethane and/or a urea group, a prepolymer having an isocyanate group at its ends is mixed with an amine capable of reacting with the prepolymer. In this case, the amine can be mixed with the prepolymer in the oil phase liquid before the toner constituent mixture is dispersed in an aqueous medium, or the amine can be directly added to the aqueous medium. The reaction time is determined depending on the reactivity of the isocyanate of the prepolymer used with the amine used. However, the reaction time is typically from 1 minute to 40 hours, and preferably from 1 to 24 hours. The reaction temperature is typically from 0 to 150° C. and preferably from 20 to 98° C. The reaction can be performed before the adherence process, or with the adherence process simultaneously. Of course, the reaction can be performed after the adherence process. In addition, known catalysts can be added, if desired, when the reaction is performed.

The toner particles dispersed in an aqueous medium are washed and dried by any known methods. In particular, the toner particles and the aqueous medium are separated by a centrifugal separator or a filter press (i.e., solid-liquid separation) so that the toner cake is prepared. Then the toner cake is re-dispersed in ion-exchanged water at a temperature of from room temperature to 40° C., following by pH control using acids and bases, if desired. The solid-liquid separation is repeated several times to remove impurities and surfactants. After the washing treatment, the toner particles are subjected to a drying treatment using a flash dryer, a circulating dryer, a vacuum dryer, a vibrating fluid dryer, etc. The toner particles having a small particle diameter can be removed by a centrifugal separation in the liquid, or the toner particles can be subjected to a classification treatment using a known classifier after the drying treatment.

The thus prepared toner particles are then mixed with one or more other particulate materials such as charge controlling agents, fluidizers optionally upon application of mechanical impact thereto to fix the particulate materials on the toner particles. Specific examples of such mechanical impact application methods include methods in which a mixture is mixed with a highly rotated blade and methods in which a mixture is put into an air jet to collide the particles against each other or a collision plate. Specific examples of such mechanical impact applicators include, but are not limited to, ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTON SYSTEM (manufactured by Kawasaki Heavy Industries, Ltd.), and automatic mortars.

(Developing Device)

Figure 4:
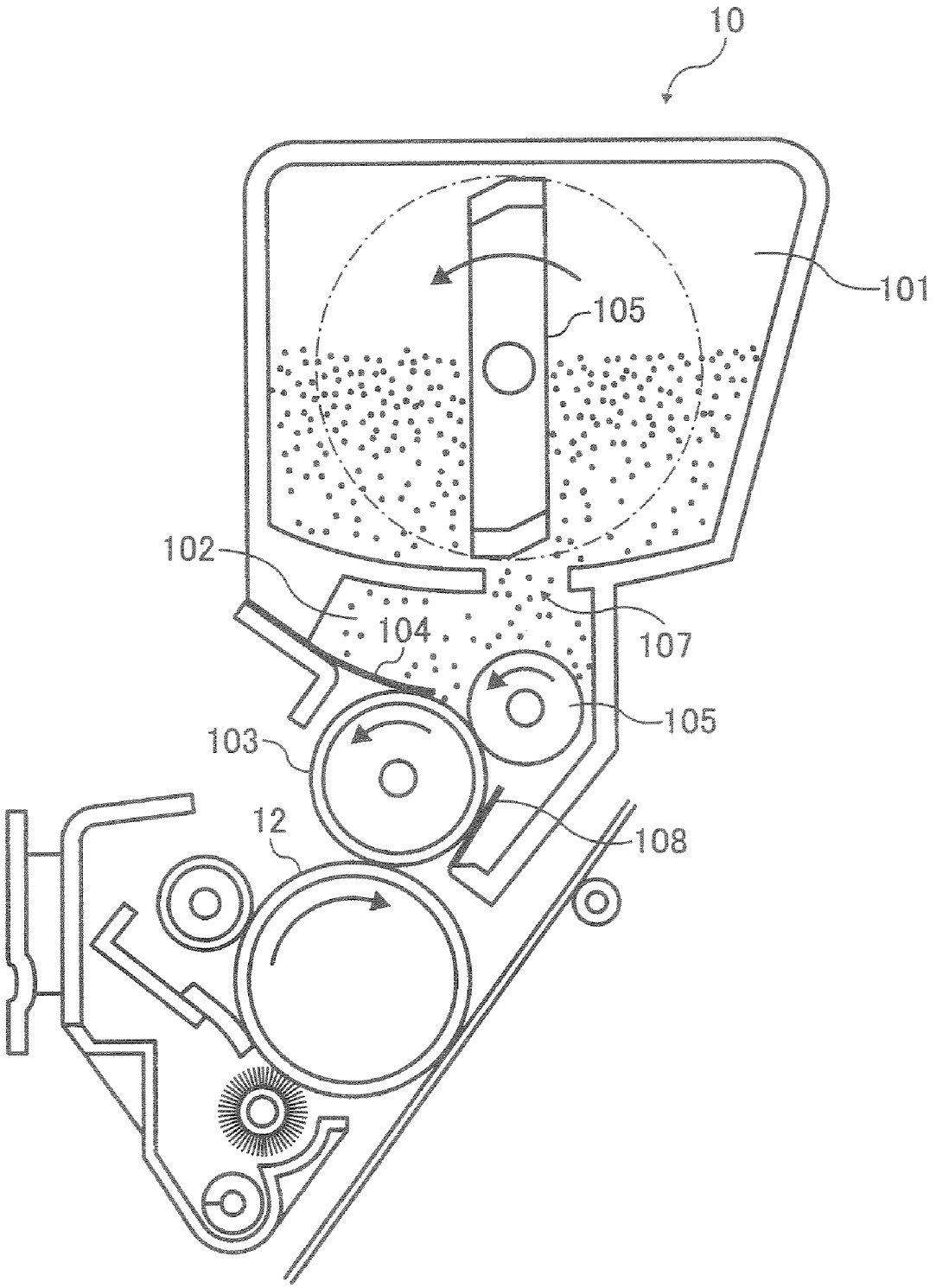
FIG. 4 is a schematic view illustrating an embodiment of the developing device for use in the present invention.

FIG. 4 is a schematic view illustrating an embodiment of a developing device for use in the present invention.

A developing device 10 comprises a toner containing chamber 101 and a toner supplying chamber 102 arranged below the toner containing chamber 101, a developing roller 103, a toner layer thickness controlling member 104 arranged in contact with the developing roller 103, and a supplying roller 105. The developing roller 103 is arranged in contact with a photoreceptor 12, and a predetermined developing bias is applied thereto from a high-voltage power supply (not shown). A toner agitation member 106 is arranged in the toner containing chamber 101 and rotates in the counterclockwise direction. Toner particles present in the vicinity of an opening 107 are agitated with the toner agitation member 106, and then fall down by gravity feed to the toner supplying chamber 102. The surface of the supplying roller 105 is covered with a foam material having a cell structure so that toner particles supplied from the toner supplying chamber 102 are efficiently adhered and the toner deterioration caused by the pressure concentration from the developing roller 103 is prevented.

A supplying bias is applied to the supplying roller 105 so that toner particles which are pre-charged at the contacting point of the supplying roller 105 with the developing roller 103 are thrust to the developing roller 103. The supplying roller 105 rotates in the counterclockwise direction so that toner particles adhered thereto are applied (supplied) to the surface of the developing roller 103. The developing roller 103 rotates in the counterclockwise direction so that the toner particles adhered thereon are transported to the position facing the toner layer thickness controlling member 104 and the photoreceptor 12. The toner layer thickness controlling member 104 includes a metal plate and a spring material, wherein the free end of the metal plate is pressed on the surface of the developing roller 103 with a pressing force of from 30 to 100 N/m. When toner particles pass through the metal plate under the pressing force, a thin toner layer is formed and the toner particles are friction-charged. Further, a controlling bias is applied to the toner layer thickness controlling member 104 in order to assist friction-charging toner particles. The photoreceptor 12 rotates in the clockwise direction, and therefore the photoreceptor 12 and the surface of the developing roller 103 move in the same direction at the facing point. The developing roller 103 rotates so that the thin toner layer is transported to the facing point with the photoreceptor 12, and then the thin toner layer moves onto the surface of the photoreceptor 12 due to the developing bias applied to the developing roller 103 and the electric field produced by the latent image formed on the photoreceptor 12. In order to prevent toner particles which do not move onto the photoreceptor 12 and remain on the developing roller 103 from getting out of the developing device, a sealing member 108 is arranged in contact with the developing roller 103.

(Process Cartridge)

Figure 5:
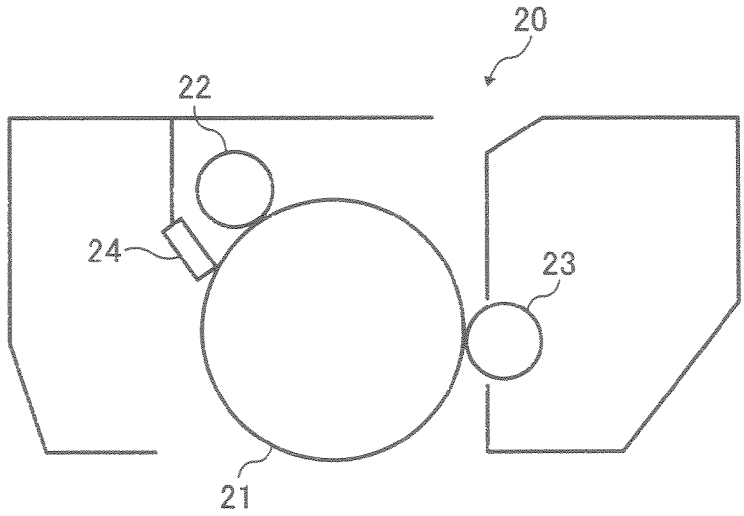
FIG. 5 is a schematic view illustrating an embodiment of the process cartridge of the present invention.

The developer of the present invention can be used for a process cartridge illustrated in FIG. 5, for example.

The process cartridge of the present invention includes a photoreceptor and any one member selected from a charger, a developing device, and a cleaning device, and is detachably attachable to an image forming apparatus such as copiers and printers.

FIG. 5 is a schematic view illustrating an embodiment of the process cartridge of the present invention. A process cartridge 20 includes a photoreceptor 21, a charger 22, a developing device 23, and a cleaning device 24.

Next, an image forming method of an image forming apparatus including the process cartridge 20 will be explained. The photoreceptor 21 rotates at a predetermined speed, and the surface thereof is charged by the charger 22 to reach to a positive or negative predetermined potential while rotating. The photoreceptor 21 is irradiated with a light containing image information emitted by a light irradiator such as a slit irradiator and a laser beam scanning irradiator, to form an electrostatic latent image thereon. The electrostatic latent image is developed with a toner in the developing device 23, and then the toner image is transferred onto a transfer material which is timely fed from a feeding part to an area formed between the photoreceptor 21 and the transfer device so as to meet the toner images on the photoreceptor 21. The transfer material having the toner images thereon is separated from the photoreceptor 21 and transported to a fixing device so that the toner image is fixed and discharged from the image forming apparatus as a copying or a printing. After the toner image is transferred, residual toner particles remaining on the photoreceptor are removed using the cleaning device 24, and then the photoreceptor is discharged. The photoreceptor 21 is used repeatedly.

(Measuring Method)

Toner properties are measured as follows in the present invention.

Particle Diameter

The volume average particle diameter (Dv), number average particle diameter (Dn), and particle diameter distribution of a toner can be measured using an instrument COULTER COUNTER TA-II or COULETR MULTISIZER II from Coulter Electrons Inc.

The typical measuring method is as follows:

(1) 0.1 to 5 ml of a surfactant (preferably alkylbenzene sulfonate) is included as a dispersant in 100 to 150 ml of an electrolyte (i.e., 1% NaCl aqueous solution including a first grade sodium chloride such as ISOTON-II from Coulter Electrons Inc.);

(2) 2 to 20 mg of a toner is added to the electrolyte and dispersed using an ultrasonic dispersing machine for about 1 to 3 minutes to prepare a toner suspension liquid;

(3) the volume and the number of toner particles are measured by the above instrument using an aperture of 100 μm to determine volume and number distribution thereof; and (4) the volume average particle diameter (Dv) and the weight average particle diameter (Dn) is determined.

The channels include 13 channels as follows: from 2.00 to less than 2.52 μm; from 2.52 to less than 3.17 μm; from 3.17 to less than 4.00 μm; from 4.00 to less than 5.04 μm; from 5.04 to less than 6.35 μm; from 6.35 to less than 8.00 μm; from 8.00 to less than 10.08 μm; from 10.08 to less than 12.70 μm; from 12.70 to less than 16.00 μm; from 16.00 to less than 20.20 μm; from 20.20 to less than 25.40 μm; from 25.40 to less than 32.00 μm; and from 32.00 to less than 40.30 μm. Namely, particles having a particle diameter of from not less than 2.00 μm to less than 40.30 μm can be measured.

Average Circularity

The shape of a particle is preferably determined by an optical detection method such that an image of the particle is optically detected by a CCD camera and analyzed. A particle suspension passes the image detector located on the flat plate so as to be detected.

The circularity of a particle is determined by the following equation:

$$\text{Circularity}=Cs/Cp$$

wherein Cp represents the length of the circumference of the image of a particle and Cs represents the length of the circumference of a circle having the same area as that of the image of the particle.

The average circularity of a toner can be determined using a flow-type particle image analyzer FPIA-2000 manufactured by Sysmex Corp. The typical measurement method is as follows:

(1) 0.1 to 0.5 ml of a surfactant (preferably alkylbenzene sulfonate) is included as a dispersant in 100 to 150 ml of water from which solid impurities have been removed;

(2) 0.1 to 0.5 g of a toner is added to the electrolyte and dispersed using an ultrasonic dispersing machine for about 1 to 3 minutes to prepare a toner suspension liquid including 3,000 to 10,000 per 1 micro-liter of the toner particles; and (3) the average circularity and circularity distribution of the toner are determined by the measuring instrument mentioned above.

Molecular Weight

The molecular weight of the resins such as polyester resins and vinyl copolymer resins are determined by GPC (Gel Permeation Chromatography) method under the following conditions:

Instrument used: HLC-8220GPC (from Tosoh Corporation)

Column; TSKgel SuperHZM-M×3

Temperature: 40° C.

Solvent: THF (tetrahydrofuran)

Flow rate: 0.35 ml/min

Sample concentration: 0.05 to 0.6% by weight

Injection volume: 0.01 ml

The molecular weight of the resin is determined while comparing the molecular distribution curve thereof with the working curve which is previously prepared using 10 polystyrene standard samples each having a single molecular weight peak. Each of standard polystyrene has a molecular weight of from $5.8\times10^2$ to $7.5\times10^6$.

Glass Transition Temperature

The glass transition temperature of the resins such as polyester resins and vinyl copolymer resins are determined with a differential scanning calorimeter (DSC) such as DSC-6200 (from Seiko Instruments Inc,). The measurement method is as follows:

(1) a sample is heated from room temperature to 150° C. at a temperature rising rate of 10° C./min and left for 10 minutes at 150° C;

(2) the sample is cooled at a temperature decreasing rate of 10° C./min; and (3) the sample is heated again from 20° C. to 150° C. at a temperature rising rate of 10° C./min to obtain an endothermic curve (i.e., a relationship between temperature and amount of heat) of the sample.

The glass transition temperature is determined by finding a shoulder of a lower baseline of the endothermic curve and the endothermic peak.

Softening Point (Tm)

One (1.0) g of a sample is set in a CAPILLARY RHEOMETER SHIMADZU FLOWMETER CFT-500 (from Shimadzu Corporation), and a flow test is performed under the following conditions.

Die: diameter 0.5 mm, height 1.0 mm

Temperature rising speed: 3.0° C./min

Preheating time: 180 sec

Load: 30 kg

Measurement temperature range: from 60 to 160° C. A temperature at which a half of the sample flowed out is defined as the softening point (Tm).

Particle Diameter of Particulate Resin

The particle diameter of a particulate resin (such as a particulate vinyl copolymer resin) can be measured with particle size distribution analyzers such as LA-920 (from Horiba Ltd. ) and UPA-EX150 (from Nikkiso Co., Ltd.), by subjecting the dispersion of the particulate resin to the measurement.

Pressing Force of Toner Layer Thickness Controlling Member

When a spring member presses a toner layer thickness controlling member, the spring me miser and the toner layer thickness controlling member are set on a balance, and then a force is applied thereon so that the spring member shrinks as much as that attached to a developing device. A pressing force (N/m) is calculated by dividing the above-measured weight by the contact length between the toner layer thickness controlling member and the developing roller.

Having generally described this invention, further understanding can be obtained by reference to certain specific examples which are provided herein for the purpose of illustration only and are not intended to be limiting. In the descriptions In the following examples, the numbers represent weight ratios in parts, unless otherwise specified.

EXAMPLES

Preparation of Polyester

The following components were fed in a reaction vessel equipped with a condenser, a stirrer and a nitrogen inlet pipe.

| | |
|---|---|
| Ethylene oxide (2 mole) adduct of bisphenol A | 553 parts |
| Propylene oxide (3 mole) adduct of bisphenol A | 196 parts |
| Terephthalic acid | 220 parts |
| Adipic acid | 45 parts |
| Dibutyltin oxide | 2 parts |

The mixture was reacted for 8 hours at 230° C. under normal pressure. Then the reaction was further continued for 5 hours under a reduced pressure of from 10 to 15 mmHg. Further, 26 parts of trimellitic anhydride was fed to the vessel to be reacted with the reaction product for 2 hours at 180° C. Thus, a polyester (P-1) was prepared.

The polyester (P-1) had a number average molecular weight (Mn) of 2,200, a weight average molecular weight (Mw) of 5,600, a glass transition temperature (Tg) of 43° C., and an acid value of 13 mgKOH/g.

Preparation of Particulate Vinyl Copolymer Resin

In a reaction vessel equipped with a condenser, a stirrer and a nitrogen inlet pipe, 1.6 parts of sodium dodecyl sulfate and 492 parts of ion-exchange water were contained and the mixture was heated to 80° C. Then a mixture of 2.5 parts of potassium persulfate (KPS, a polymerization initiator) and 100 parts of ion-exchange water were added thereto. After 15-minutes left, a mixture of the following components was gradually added thereto over a period of 90 minutes.

| | |
|---|---|
| Styrene monomer | 152 parts |
| Butyl acrylate | 38 parts |
| Methacrylic acid | 10 parts |
| n-Octyl mercaptan (NOM) (a molecular weight controlling agent) | 3.5 parts |

The mixture was kept for 60 minutes at 80° C., and then cooled down. Thus, an aqueous dispersion of a particulate vinyl copolymer resin (V-1) was prepared.

The particulate vinyl copolymer resin (V-1) had an average particle diameter of 50 nm. A part of the dispersion was contained in a petri dish so that a dispersion medium (i.e., water) was removed and a solid material (i.e., particulate vinyl copolymer resin) can be obtained. The particulate vinyl copolymer resin (V-1) had a number average molecular weight (Mn) of 11,000, a weight average molecular weight (Mw) of 18,000, and a glass transition temperature (Tg) of 65° C.

Preparation of Prepolymer

The following components were fed in a reaction vessel equipped with a condenser, a stirrer and a nitrogen inlet pipe.

| | |
|---|---|
| Ethylene oxide (2 mole) adduct of bisphenol A | 682 parts |
| Propylene oxide (2 mole) adduct of bisphenol A | 81 parts |
| Terephthalic acid | 283 parts |
| Trimellitic anhydride | 22 parts |
| Dibutyl tin oxide | 2 parts |

The mixture was reacted for 8 hours at 230° C. under normal pressure. Then the reaction was further continued for 5 hours under a reduced pressure of from 10 to 15 mmHg. Thus, an intermediate polyester resin (1) was prepared. The intermediate polyester (1) had a number average molecular weight (Mn) of 2,100, a weight average molecular weight (Mw) of 9,500, a glass transition temperature (Tg) of 55° C., an acid value of 0.5 mgKOH/g, and a hydroxyl value of 49 mgKOH/g.

In a reaction vessel equipped with a condenser, a stirrer and a nitrogen inlet pipe, 411 parts of the intermediate polyester resin (1), 89 parts of isophorone diisocyanate, and 500 parts of ethyl acetate were mixed and the mixture was heated at 100° C. for 5 hours to perform the reaction. Thus, a polyester prepolymer (1) having an isocyanate group was prepared. A ratio of free isocyanate group included in the polyester prepolymer (1) was 1.53% by weight.

Preparation of Master Batch

The following components were mixed using a HENSCHEL MIXER.

| | |
|---|---|
| Carbon black (REGAL 400R from Cabot Corp.) | 40 parts |
| Polyester resin (RS-801 from Sanyo Chemical Industries Ltd., having an acid value of 10 mgKOH/g, Mw of 20,000, and Tg of 64° C.) | 60 parts |
| Water | 30 parts |

The mixture was kneaded with a two-roll mill for 45 minutes at 130° C., and then pulverized into particles having a particle diameter of 1 mm using a pulverizer. Thus, a master batch (1) was prepared.

Example 1

Preparation of Colorant/Wax Dispersion

In a reaction vessel equipped with a stirrer and a thermometer, 543.5 parts of the polyester (P-1), 181 parts of a carnauba wax, and 1450 parts of ethyl acetate were mixed and the mixture was heated to 80° C. while agitated. After being heated at 80° C. for 5 hours, the mixture was cooled to 30° C.

over a period of 1 hour. Then 500 parts of the master batch (1) and 100 parts of ethyl acetate were added to the vessel, and the mixture was agitated for 1 hour to prepare a raw material mixture liquid (1).

Then 1500 parts of the raw material mixture liquid (1) were subjected to a dispersion treatment using a bead mill (ULTRAVISCOMILL (trademark) from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Then 655 parts of a 65% ethyl acetate solution of the polyester (P-1) were added thereto. The mixture was subjected to the dispersion treatment using the bead mill. The dispersion conditions were the same as those mentioned above except that the dispersion operation was performed once (i.e., one pass). Some ethyl acetate was added thereto so that the mixture had a solid content of 50% by weight (at 130° C.×3). Thus, a colorant/wax dispersion (1) was prepared.

Preparation of Water Phase 968 parts of ion-exchange water, 40 parts of a 25% by weight of aqueous solution of a particulate resin (a copolymer of styrene-methacrylic acid-butyl acrylate-sodium salt of a sulfuric acid ester of ethylene oxide adduct of methacrylic acid) serving as a dispersion stabilizer, 150 parts of a 48.5% by weight of aqueous solution of a sodium salt of dodecyldiphenyl ether disulfonic acid (ELEMINOL MON-7 from Sanyo Chemical Industries Ltd.), and 98 parts of ethyl acetate were mixed. As a result, a milky liquid was prepared. Thus, a water phase (1) was prepared.

Emulsification

Then the following components were mixed in a vessel.

| | |
|---|---|
| Colorant/wax dispersion (1) | 976 parts |
| Isophorone diamine | 2.6 parts |

The components were mixed for 1 minute using a mixer TK HOMOMIXER (from Tokushu Kika Kogyo K.K.) at a revolution of 5,000 rpm. Then 88 parts of the prepolymer (1) was added thereto and mixed for 1 minute using a mixer TK HOMOMIXER (from Tokushu Kika Kogyo K.K.) at a revolution of 5,000 rpm.

Then 1200 parts of the water phase (1) was added thereto. The mixture was agitated for 20 minutes with a mixer TK HOMOMIXER (from Tokushu Kika Kogyo K.K.) at a revolution of from 8,000 to 13,000 rpm. Thus, an emulsion (1) was prepared.

Solvent Removal

The emulsion (1) was fed into a container equipped with a stirrer and a thermometer, and heated for 8 hours at 30° C. to remove the organic solvent therefrom. Thus, a dispersion (1-1) was prepared.

Adherence of Particulate Resin

The dispersion of the particulate vinyl copolymer resin (V-1) was added to the dispersion (1-1) so that the mixture had a solid content of 15% by weight. The mixture was heated to 73° C. over a period of 30 minutes. A mixture liquid of 100 parts of ion-exchange water and 100 parts of magnesium chloride hexahydrate was gradually added thereto and kept for 4 hours at 73° C. Then the mixture was controlled to have a pH of 5 by adding an aqueous solution of hydrochloric acid. The mixture was heated to 80° C. for 2 hours, and then cooled down. Thus, a dispersion (1-2) was prepared.

Washing and Drying

One hundred (100) parts of the dispersion (1-2) was filtered under a reduced pressure.

The thus obtained wet cake was mixed with 100 parts of ion-exchange water and the mixture was agitated for 10 minutes with a TK HOMOMIXER at a revolution of 12,000 rpm, followed by filtering. Thus, a wet cake (1) was prepared.

The wet cake (1) was mixed with 900 parts of ion-exchange water and the mixture was agitated for 30 minutes with a TK HOMOMIXER at a revolution of 12,000 rpm under application of an ultrasonic wave, followed by filtering under a reduced pressure. This washing operation was repeated until the mixture (i.e., re-slurry liquid) had an electric conductivity of not greater than 10 μC/cm. Thus, a wet cake (2) was prepared.

A re-slurry liquid of the wet cake (2) was mixed with a 10% aqueous solution of hydrochloric acid so that the re-slurry liquid had a pH of 4. The re-slurry liquid was agitated for 30 minutes with a stirrer, followed by filtering. Thus, a wet cake (3) was prepared.

The wet cake (3) was mixed with 100 parts of ion-exchange water and the mixture was agitated for 10 minutes with a TK HOMOMIXER at a revolution of 12,000 rpm, followed by filtering. This washing operation was repeated until the mixture (i.e., re-slurry liquid) had an electric conductivity of not greater than 10 μC/cm. Thus, a wet cake (4) was prepared.

The wet cake (4) was dried for 48 hours at 45° C. using a circulating air drier, followed by sieving with a screen having openings of 75 μm. Thus, a mother toner (1) was prepared.

The mother toner (1) had a volume average particle diameter (Dv) of 5.8 μm, a number average particle diameter (Dn) of 5.2 μm, a particle diameter distribution Dv/Dn of 1.12, and an average circularity of 0.973.

Adherence of External Additive

Then 100 parts of the mother toner (1) were mixed with 0.5 parts of a hydrophobized silica having a BET specific surface area of 200 $m^2/g$ and 0.5 parts of another hydrophobized silica having a BET specific surface area of 50 $m^2/g$ using a HENSCHEL MIXER FM20C/I (from Mitsui Mining Co., Ltd.) for 5 minutes.

The HENSCHEL MIXER was equipped with an upper blade A0 and a lower blade ST. The peripheral speed of the tip of the lower blade was fixed at 40 m/sec.

Thus, a toner (1) was prepared.

Example 2

The procedure for preparation of the toner in Example 1 was repeated except that the amount of the polyester (P-1) used for preparing the colorant/wax dispersion (1) was changed from 543.5 to 514.5 parts, and the amount of the prepolymer (1) used in the emulsification was changed from 88 to 117 parts.

Thus, a toner (2) was prepared.

Example 3

The procedure for preparation of the toner in Example 1 was repeated except that the amount of the polyester (P-1) used for preparing the colorant/wax dispersion (1) was changed from 543.5 to 485.5 parts, and the amount of the prepolymer (1) used in the emulsification was changed from 88 to 146 parts.

Thus, a toner (3) was prepared.

Example 4

The procedure for preparation of the toner in Example 1 is repeated except that the amount of the polyester (P-1) used for preparing the colorant/wax dispersion (1) is changed from 543.5 to 573.5 parts, and the amount of the prepolymer (1) used in the emulsification is changed from 88 to 58 parts.

Thus, a toner (4) is prepared,

Example 5

The procedure for preparation of the toner in Example 1 is repeated except that the conditions for preparing the prepolymer are changed so that the intermediate polyester (1) has a number average molecular weight (Mn) of 2,300 and a weight average molecular weight (Mw) of 11,500.

Thus, a toner (5) is prepared.

Example 6

The procedure for preparation of the toner in Example 1 is repeated except that the conditions for preparing the prepolymer are changed so that the intermediate polyester (1) has a number average molecular weight (Mn) of 2,500 and a weight average molecular -weight (Mw) of 13,500.

Thus, a toner (6) is prepared,

Example 7

The procedure for preparation of the toner in Example 5 is repeated except that the amount of the polyester (P-1) used for preparing the colorant/wax dispersion (1) is changed from 543.5 to 514.5 parts, and the amount of the prepolymer (1) used in the emulsification is changed from 88 to 117 parts.

Thus, a toner (7) is prepared.

Comparative Example 1

Preparation of Particulate Resin

In a reaction vessel equipped with a stirrer and a thermometer, 683 parts of water, 11 parts of a sodium salt of sulfate of an ethylene oxide adduct of methacrylic acid (ELEMINOL RS-30 from Sanyo Chemical Industries Ltd. ), 166 parts of methacrylic acid, 110 parts of butyl acrylate, and 1 part of ammonium persulfate were contained and the mixture was agitated with the stirrer for 30 minutes at a revolution of 6,400 rpm. As a result, a milky emulsion was prepared. Then the emulsion was heated to 75° C. to react the monomers for 4 hours.

Further, 30 parts of a 1% aqueous solution of ammonium persulfate were added thereto, and the mixture was aged for 6 hours at 75° C. Thus, an aqueous dispersion (1) (i.e., particle dispersion (1)) of a vinyl resin (1) (i.e., a copolymer of methacrylic acid/butyl acrylate/sodium salt of sulfate of ethylene oxide adduct of methacrylic acid) was prepared.

The particulate vinyl resin (1) had a volume average particle diameter of 110 nm, which was determined by a particle size distribution analyzer LA-920 (manufactured by Horiba, Ltd. ). A part of the particle dispersion was dried to isolate the resin. The vinyl resin (1) had a glass transition temperature (Tg) of 58° C., and a weight average molecular weight (Mw) of 130,000.

Preparation of Water Phase 990 parts of water, 83 parts of the particle dispersion (1) prepared above, 37 parts of an aqueous solution of a sodium salt of dodecyl diphenyl ether disulfonic acid (ELEMINOL MON-7 from Sanyo Chemical Industries Ltd., solid content of 48.3%), and 90 parts of ethyl acetate were mixed. As a result, a water phase (2) was prepared.

Preparation of Low-Molecular-Weight Polyester

The following components were fed in a reaction vessel equipped with a condenser, a stirrer and a nitrogen feed pipe.

| | |
|---|---|
| Ethylene oxide (2 mole) adduct of bisphenol A | 229 parts |
| Propylene oxide (3 mole) adduct of bisphenol A | 529 parts |
| Terephthalic acid | 208 parts |
| Adipic acid | 46 parts |
| Dibutyltin oxide | 2 parts |

The mixture was reacted for 7 hours at 230° C. under normal pressure. Then the reaction was further continued for 5 hours under a reduced pressure of 10 to 15 mmHg. Further, 44 parts of trimellitic anhydride was fed to the container to be reacted with the reaction product for 3 hours at 180° C. Thus, a low-molecular-weight polyester (1) was prepared.

The low-molecular-weight polyester (1) had a number average molecular weight (Mn) of 2,300, a weight average molecular weight (Mw) of 6,700, a glass transition temperature (Tg) of 43° C., and an acid value of 24 mgKOH/g.

Preparation of Prepolymer

The following components were fed in a reaction vessel equipped with a condenser, a stirrer and a nitrogen feed pipe.

| | |
|---|---|
| Ethylene oxide (2 mole) adduct of bisphenol A | 682 parts |
| Propylene oxide (2 mole) adduct of bisphenol A | 81 parts |
| Terephthalic acid | 283 parts |
| Trimellitic anhydride | 22 parts |
| Dibutyl tin oxide | 2 parts |

The mixture was reacted for 7 hours at 230° C. under normal pressure. Then the reaction was further continued for 5 hours under a reduced pressure of 10 to 15 mmHg. Thus, an intermediate polyester (2) was prepared.

The intermediate polyester (2) had a number average molecular weight (Mn) of 2,200, a weight average molecular weight (Mw) of 9,700, a glass transition temperature (Tg) of 54° C., an acid value of 0.5 mgKOH/g, and a hydroxyl value of 52 mgKOH/g.

In a reaction vessel equipped with a condenser, a stirrer and a nitrogen feedpipe, 410 parts of the Intermediate polyester (2), 89 parts of isophorone diisocyanate, and 500 parts of ethyl acetate wer mixed and the mixture was heated for 5 hours at 100° C. to perform the reaction. Thus, a polyester prepolymer (2) having an isocyanate group was prepared. The content of free isocyanate in the polyester prepolymer (2) was 1.53% by weight.

Synthesis of Ketimine

In a reaction vessel equipped with a stirrer and a thermometer, 170 parts of isophorone diamine and 75 parts of methyl ethyl ketone were mixed and reacted for 4.5 hours at 50° C. to prepare a ketimine compound (1). The ketimine compound (1) had an amine value of 417 mgKOH/g.

Preparation of Master Batch

The following components were mixed with a HENSCHEL MIXER (manufactured by Mitsui Mining Co., Ltd.).

| | |
|---|---|
| Water | 1200 parts |
| Carbon Black (Printex35 from Degussa Japan Co., Ltd., having a DBP absorption value of 42 ml/100 mg pH of 9.5) | 540 parts |
| Polyester resin (RS801 from Sanyo Chemical Industries Ltd.) | 1200 parts |

The mixture was kneaded for 1 hour at 130° C. with a two-roll mill, and then subjected to rolling and cooling. The rolled mixture was pulverized using a pulverizer. Thus, a master batch (2) was prepared.

Preparation of Wax/Colorant Dispersion

In a vessel equipped with a stirrer and a thermometer, 378 parts of the low-molecular-weight polyester (1), 100 parts of a carnauba wax, and 947 parts of ethyl acetate were contained. The mixture was heated to 80° C. for 5 hours while agitated, and then cooled to 30° C. over a period of 1 hour. Further, 500 parts of the master batch (2) and 500 parts of ethyl acetate were added thereto and agitated for 1 hour to prepare a raw material dispersion (2).

Then 1324 parts of the raw material dispersion (2) was subjected to a dispersion treatment using a bead mill (ULTRAVISCOMILL (trademark) from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Then 1324 parts of a 65% ethyl acetate solution of the low-molecular-weight polyester (1) were added thereto. The mixture was subjected to the dispersion treatment using the bead mill. The dispersion conditions were the same as those mentioned above except that the dispersion operation was performed twice (i.e., two passes).

Thus, a wax/colorant dispersion (2) was prepared. A solid content of the wax/colorant dispersion (2) was 50% by weight (when the liquid was heated for 30 minutes at 130° C.).

Emulsification

In a vessel, 749 parts of the wax/colorant dispersion (2), 115 parts of the prepolymer (2), and 2.9 parts of the ketimine compound (1) were contained and agitated for 2 minutes at a revolution of 5,000 rpm using a TK HOMOMIXER (from Tokushu Kika Kogyo K.K.). Next, 1200 parts of the water phase (2) were added thereto , The mixture was agitated for 50 minutes at a revolution of 13,000 rpm using a TK HOMOMIXER. As a result, an emulsion slurry (2) was prepared.

Solvent Removal

The emulsion slurry (2) was fed into a reaction vessel equipped with a stirrer and a thermometer, and then heated for 8 hours at 30° C. to remove the organic solvent (ethyl acetate) therefrom. Then the emulsion slurry (2) was aged for 7 hours at 45° C. Thus, a dispersion slurry (2) was prepared.

Washing and Drying

One hundred (100) parts of the dispersion slurry (2) was filtered under a reduced pressure.

The thus obtained wet cake was mixed with 100 parts of ion-exchange water and the mixture was agitated for 10 minutes with a TK HOMOMIXER at a revolution of 12,000 rpm, followed by filtering. Thus, a wet cake (i) was prepared.

The wet cake (ii) was mixed with 100 parts of a 10% aqueous solution of sodium hydroxide and the mixture was agitated for 30 minutes with a TK HOMOMIXER at a revolution of 12,000 rpm, followed by filtering under a reduced pressure. Thus, a wet cake (ii) was prepared.

The wet cake (ii) was mixed with 100 parts of a 10% aqueous solution of hydrochloric acid and the mixture was agitated for 10 minutes with a TK HOMOMIXER at a revolution of 12,000 rpm, followed by filtering. Thus, a wet cake (iii) was prepared.

The wet cake (iii) was mixed with 300 parts of ion-exchange water and the mixture was agitated for 10 minutes with a TK HOMOMIXER at a revolution of 12,000 rpm, followed by filtering. This operation was performed twice. Thus, a wet cake (iv) was prepared.

The wet cake (iv) was dried for 48 hours at 45° C. using a circulating air drier, followed by sieving with a screen having openings of 75 μm. Thus, a mother toner (2) was prepared.

The mother toner (2) was mixed with external additives in the same way as Example 1.

Thus, a comparative toner (C1) was prepared.

Comparative Example 2

At first, 450 parts of a 0.1 M aqueous solution of $Na_3PO_4$ were added to 400 parts of ion-exchange water. The mixture was heated to 60° C., and then agitated using a mixer CLEARMIX® CLS-30S (from M Technique Co., Ltd.) at a revolution of 4,500 rpm.

Further, 68 parts of a 0.1 M aqueous solution of $CaCl_2$ were gradually added thereto. Thus, an aqueous medium including calcium phosphate was prepared.

On the other hand, the following components were uniformly mixed and the mixture was heated to 60° C.

| | |
|---|---|
| Styrene | 160 parts |
| n-Butyl acrylate | 40 parts |
| C. I. Pigment Blue 15:3 | 10 parts |
| Metal compound of di-t-butyl salicylic acid | 2 parts |
| Saturated polyester (having an acid value of 15 mgKOH/g and a peak molecular weight of 12,000) | 10 parts |
| Ester wax (having a melting point 60° C.) | 30 parts |
| Divinylbenzene | 0.3 parts |

In addition, 5 parts of a polymerization initiator 2,2'-azobis (2,4-dimethylvaleronitrile) were added thereto. Thus, a monomer composition was prepared.

The monomer composition was added to the aqueous medium prepared above, and then the mixture was agitated for 15 minutes using the CLEARMIX® at a revolution of 4,500 rpm at 65° C. under $N_2$ atmosphere so that the monomer composition was granulated.

The mixture was then heated to 70° C. and reacted for 12 hours while agitated by a paddle stirrer. After the reaction was terminated, unreacted monomers were removed at 80° C. under a reduced pressure, and then the mixture was cooled. Then hydrochloric acid was added thereto and calcium phosphate was dissolved therein. The mixture was filtered, washed, and dried. Thus, a colored particulate material was prepared. The colored particulate material had a weight average molecular weight (Mw) of 500,000.

The colored particulate material was mixed with external additives in the same way as Example 1.

Thus, a comparative toner (C2) was prepared.

Comparative Example 3

Preparation of Binder Resin Dispersion (1)

The following components were mixed to prepare a monomer composition.

| | |
|---|---|
| Styrene | 290 parts |
| n-Butyl acrylate | 110 parts |
| Acrylic acid | 6 parts |
| Dodecanethiol | 6 parts |
| Carbon tetrabromide | 4 parts |
| (all from Wako Pure Chemical Industries, Ltd.) | |

The monomer composition was emulsified in an aqueous solution in which 6 parts of a nonionic surfactant (NONIPOL 400 from Sanyo Chemical Industries, Ltd.) and 10 parts of an anionic surfactant (NEOGEN SC from Dai-ichi Kogyo Seiyaku Co., Ltd.) were dissolved in 550 parts of ion-exchange water, contained in a flask. The emulsion was mixed slowly for 20 minutes, and then 50 parts of ion-exchange water in which 4 parts of ammonium persulfate were dissolved therein were added thereto. The flask was filled with nitrogen gas, and then the mixture was heated to 80° C. by an oil bath while agitated. The mixture was subjected to an emulsion polymerization for 5 hours.

Thus, a binder resin dispersion (1) containing a particulate resin having a number average particle diameter of 125 nm, a glass transition temperature (Tg) of 49° C., and a weight average molecular weight (Mw) of 32,500 was prepared.

Preparation of Binder Resin Dispersion (2)

The following components were mixed to prepare a monomer composition.

| | |
|---|---|
| Styrene | 340 parts |
| n-Butyl acrylate | 60 parts |
| Acrylic acid | 6 parts |
| Dodecanethiol | 6 parts |
| Carbon tetrabromide | 4 parts |
| (all from Wako Pure Chemical Industries, Ltd.) | |

The monomer composition was emulsified in an aqueous solution in which 6 parts of a nonionic surfactant (NONIPOL 400 from Sanyo Chemical Industries, Ltd.) and 12 parts of an anionic surfactant (NEOGEN SC from Dai-ichi Kogyo Seiyaku Co., Ltd.) were dissolved in 550 parts of ion-exchange water, contained in a flask. The emulsion was mixed slowly for 10 minutes, and then 50 parts of ion-exchange water in which 3 parts of ammonium persulfate were dissolved therein were added thereto. The flask was filled with nitrogen gas, and then the mixture was heated to 70° C. by an oil bath while agitated. The mixture was subjected to an emulsion polymerization for 5 hours.

Thus, a binder resin dispersion (2) containing a particulate resin having a number average particle diameter of 215 nm, a glass transition temperature (Tg) of 64.8° C., and a weight average molecular weight (Mw) of 49,000 was prepared.

Preparation of Colorant Dispersion

The following components were mixed for 10 minutes using a homogenizer (ULTRA-TURRAX® T50 from IKA® Japan).

| | |
|---|---|
| Carbon black (MOGUL ® L from Cabot Corporation) | 50 parts |
| Nonionic surfactant (NONIPOL 400 from Sanyo Chemical Industries, Ltd.) | 5 parts |
| Ion-exchange water | 200 parts |

Thus, a colorant dispersion containing black colorant particles having a volume average particle diameter of 200 nm was prepared.

Preparation of Release Agent Dispersion

The following components were mixed for 10 minutes using a homogenizer (ULTRA-TURRAX® T50 from IKA® Japan) in a stainless round flask.

| | |
|---|---|
| Paraffin wax (HNP0190 from Nippon Seiro Co., Ltd.) | 50 parts |
| Cationic surfactant (SANISOL B50 from Kao Corporation) | 5 parts |
| Ion-exchange water | 200 parts |

Then the mixture was subjected a dispersion treatment using a pressure discharging homogenizer.

Thus, a release agent dispersion containing release agent particles having a number average particle diameter of 160 nm was prepared.

Preparation of Colored Particulate Material

The following components were mixed using a homogenizer (ULTRA-TURRAX® T50 from IKA® Japan) in a stainless round flask.

| | |
|---|---|
| Binder resin dispersion (1) | 150 parts |
| Colorant dispersion | 200 parts |
| Release agent dispersion | 40 parts |
| Cationic surfactant (SANISOL B50 from Kao Corporation) | 5 parts |

The flask was heated to 48° C. using an oil bath over a period of 150 minutes while agitating the mixture. Further, the flask was heated to 52° C. over a period of 100 minutes. Next, 100 parts of the binder resin dispersion (2) were added thereto at 52° C. and the mixture was left for 15 minutes. Then 3 parts of an anionic surfactant (NEOGEN RK from Dai-ichi Kogyo Seiyaku Co., Ltd.) were added to the mixture. The flask was hermetically sealed and heated to 93° C. for 2 hours while agitating the mixture using a magnetic seal. The mixture was cooled, and then the reaction product was subjected to filtering, washing with ion-exchange water, and drying. Thus, a colored particulate material was prepared.

The colored particulate material was mixed with external additives in the same way as Example 1.

Thus, a comparative toner (C3) was prepared.

Comparative Example 4

At first, 0.90 kg of sodium n-dodecyl sulfate were dissolved in 10.0 liters of pure water. Then 1.20 kg of a carbon black (REGAL® 330R from Cabot Corporation) were gradually added thereto and agitated for 1 hour. The mixture was subjected to a dispersion treatment for 20 hours using a sand grinder (i.e., a dispersing machine using a medium). Thus, a colorant dispersion (1) was prepared.

On the other hand, 0.055 kg of sodium dodecylbenzene sulfonate were mixed with 4.0 liters of ion-exchange water to prepare an anionic surfactant solution (A). Further, 0.014 kg of polyethylene oxide 10 mol adduct of nonylphenol were mixed with 4.0 liters of ion-exchange water to prepare a nonionic surfactant solution (B). Moreover, 223.8 g of potassium persulfate were mixed with 12.0 liters of ion-exchange water to prepare an initiator solution (C).

In a 100 L glass-lined reaction tank (in which the intersection angle α of agitation blades was 20°) equipped with a thermometer, a condenser, and a nitrogen inlet pipe, 3.41 kg of a wax emulsion (an emulsion of a polypropylene having a number average molecular weight of 3,000 and a number average primary particle diameter of 120 nm, having a solid content of 29.9%), the anionic surfactant solution (A), and the nonionic surfactant solution (B) were contained and the mixture was agitated. Further, 44.0 liters of ion-exchange water were added thereto.

The mixture was heated to 75° C., and then the initiator solution (C) was added thereto. A mixture liquid of 12.1 kg of styrene, 2.88 kg of n-butyl acrylate, 1.04 kg of methacrylic acid, and 548 g of t-dodecyl mercaptan were dropped therein while controlling the temperature in a range of from 74 to 76° C. The mixture was heated to have a temperature of from 79 to 81° C. and agitated for 6 hours, and then cooled to 40° C. or less and the agitation was stopped. Then the mixture was filtered with a PALL FILTER. Thus, a latex (a) was prepared.

The particulate resin included in the latex (a) had a glass transition temperature of 57° C., a softening point of 121° C., a weight average molecular weight of 12,700, and a weight average particle diameter of 120 nm.

Next, 0.055 kg of sodium dodecylbenzene sulfonate were mixed with 4.0 liters of ion-exchange water to prepare an anionic surfactant solution (D). In addition, 0.014 kg of polyethylene oxide 10 mol adduct of nonylphenol were mixed with 4.0 liters of ion-exchange water to prepare a nonionic surfactant solution (E). Moreover, 200.7 g of potassium persulfate (from Kanto Chemical Co., Inc.) were mixed with 12.0 liters of ion-exchange water to prepare an initiator solution (F).

In a 100 L glass-lined reaction tank equipped with a thermometer, a condenser, a nitrogen inlet pipe, and a comb baffle, 3.41 kg of a wax emulsion (an emulsion of a polypropylene having a number average molecular weight of 3,000 and a number average primary particle diameter of 120 nm, having a solid content of 29.9%), the anionic surfactant solution (D), and the nonionic surfactant solution (E) were contained and the mixture was agitated. Further, 44.0 liters of ion-exchange water were added thereto.

The mixture was heated to 70° C., and then the initiator solution (F) was added thereto. A mixture liquid of 11.0 kg of styrene, 4.00 kg of n-butyl acrylate, 1.04 kg of methacrylic acid, and 9.02 g of t-dodecyl mercaptan was dropped therein. The mixture was controlled to have a temperature of from 70 to 74° C. and agitated for 6 hours. Further, the mixture was controlled to have a temperature of from 78 to 82° C. and agitated for 12 hours, and then cooled to 40° C. or less and the agitation was stopped. Then the mixture was filtered with a PALL FILTER. Thus, a latex (b) was prepared.

The particulate resin included in the latex (b) had a glass transition temperature of 58° C., a softening point of 132° C., a weight average molecular weight of 24,5000, and a weight average particle diameter of 110 nm.

Next, 5.36 kg of sodium chloride serving as a salting-out agent was dissolved in 20.0 liters of ion-exchange water to prepare a sodium chloride solution (G). In addition, 1.00 g of a fluorine-containing nonionic surfactant was mixed with 1.0 liter of ion-exchange water to prepare a nonionic surfactant solution (H).

In a 100 L SITS reaction tank equipped with a thermometer, a condenser, a monitor for particle diameter and shape, 20.0 kg of the latex (a), 5.2 kg of the latex (b), 0.4 kg of the colorant dispersion (1), and 20.0 kg of ion-exchange water were contained and the mixture was agitated. The mixture was heated to 40° C., and then the sodium chloride solution (G), 6.00 kg of isopropanol (from Kanto Chemical Co., Inc.), and the nonionic surfactant solution (H) were added thereto in this order. The mixture was left for 10 minutes, and then heated to 85° C. over a period of 60 minutes. The mixture was agitated for 0.5 to 3 hours at a revolution of from 160 to 165 rpm while controlled to have a temperature of from 83 to 87° C. so that particles were salted-out and fused. Finally, 2.1 liters of pure water were added thereto to terminate the growth of the particles. Thus, a dispersion containing fused particles was prepared.

In a 5 L reaction vessel equipped with a thermometer, a condenser, a monitor for particle diameter and shape, 5.0 kg of the dispersion prepared above were contained and agitated for 0.5 to 15 hours at a revolution of from 160 to 165 rpm while controlled to have a temperature of from 83 to 87° C. so as to control the shapes of the particles. Then the mixture was cooled to 40° C. or less and the agitation was stopped. The mixture was subjected to centrifugal sedimentation using a centrifugal separator so as to classify the fused particles, and then filtered with a sieve having openings of 45 μm. Thus, an association liquid (i.e., the filtrate) was prepared.

A wet cake of the shape-controlled particles was obtained from the association liquid using a Buchner funnel, and then washed with ion-exchange water. The wet cake was dried with a flash jet dryer at an intake temperature of 60° C., and then dried with a fluidized bed dryer at a temperature of 60° C. Thus, a colored particulate material was prepared.

The colored particulate material was mixed with external additives in the same way as Example 1.

Thus, a comparative toner (C4) was prepared.

Comparative Example 5

The procedure for preparation of the toner in Comparative Example 2 is repeated except that the reaction conditions are changed so that the colored particulate material has a weight average molecular weight (Mw) of 650,000.

Thus, a comparative toner (C5) is prepared.

Evaluations

Toner properties of the toners were measured by the above-mentioned method and the results are shown in Table 1.

In addition, each of the toners was subjected to the following evaluations and the results are shown in Table 2.

Background Fouling

A toner was set in an IPSIO CX2500 (from Ricoh Co., Ltd. ) modified so that the toner layer thickness controlling member had a pressing force of 70 N/m. A running test in which 2,000 copies of a printing pattern having an image area proportion of 6% are continuously produced was performed at 23° C. and 45% RH. After the running test, the resultant images wer visually observed to determine whether background fouling occurs or not. The evaluation was performed as follows:

Good: No background fouling occurs.

Average: Background fouling slightly occurs. No problem in practical use.

Poor: Background fouling occurs. Having problem in practical use.

Hollow Defect

A toner was set in an IPSIO CX2500 (from Ricoh Co., Ltd. ) modified so that the toner layer thickness controlling member had a pressing force of 70 N/m. A running test in which 2,000 copies of a printing pattern having an image area proportion of 6% are continuously produced was performed at 23° C. and 45% RH. The bias was controlled so that 1.4 mg/cm$^2$ of a toner was adhered to the intermediate transfer medium when the printing pattern was produced. After the running test, the resultant images were visually observed to determine whether hollow defect occurs or not. The evaluation was performed as follows:

Good: No hollow defect occurs.

Average: Hollow defect slightly occurs. No problem in practical use.

Poor: Hollow defect seriously occurs. Having problem in practical use.

Cleanability

A toner was set in an IPSIO CX2500 (from Ricoh Co., Ltd. ) modified so that the toner layer thickness controlling member had a pressing force of 70 N/m. A running test in which 2,000 copies of a printing pattern having an image area proportion of 6% are continuously produced was performed at 23° C. and 45% RH. After the running test, the photoreceptor and the intermediate transfer medium were visually observed to evaluate cleanability. The evaluation was performed as follows:

Good: No toner particles remain and no toner film is formed on both the photoreceptor and the intermediate transfer medium.

Average: Toner particles slightly remain and toner films are slightly formed on the photoreceptor and/or the intermediate transfer medium. No problem in practical use.

Poor: Toner particles remain and toner films are formed on the photoreceptor and/or the intermediate transfer medium. Having problem in practical use.

Fixability

A toner was set in an IPSIO CX2500 (from Ricoh Co., Ltd.) modified so that the toner layer thickness controlling member had a pressing force of 70 N/m. An unfixed 36 mm-wide strip solid image (toner content: 9 g/m$^2$) was formed on the A4-size paper at a position of 3 mm behind the tip thereof while the A4-size paper was fed in the vertical direction. The unfixed image was fixed using a fixing device illustrated in FIG. 5 at a temperature of from 130° C. to 190° C. in 10° C. steps so that a toner-fixable temperature range can be determined. In the toner-fixable temperature range, separation of the paper from the heating roller is well performed, offset problem does not occur, and the image hardly peels off. The paper used for the evaluation had a basic weight of 45 g/m$^2$ and a cross direction. The paper was fed in the vertical direction in which a paper having a cross direction has a disadvantage for the paper separation. The feeding speed of the fixing device was 120 mm/sec.

The fixed image was subjected to a fixing strength test (i.e., drawning test).

Figure 6:
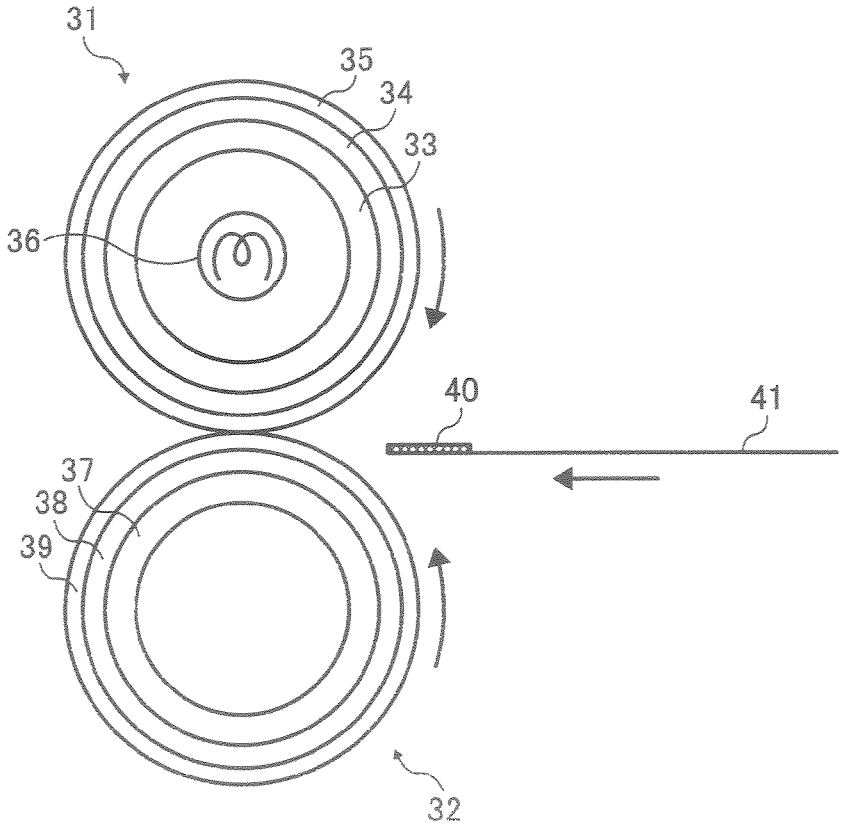
FIG. 6 is a schematic view illustrating an embodiment of a fixing device for fixing the toner of the present invention.

FIG. 6 is a schematic view illustrating the fixing device used for the evaluation of the toner of the present invention. The fixing device includes a soft roller having a fluorinated outermost layer.

In particular, a heating roller 31 having an external diameter of 40 mm includes:

an aluminum cored bar 33;

an elastic layer 34 having a thickness of 1.5 mm and including a silicone rubber, which is located on the aluminum cored bar 33;

an outermost layer 35 including PFA (tetrafluoroethylene-perfluoro(alkylvinyl)ether copolymer), which is located on the elastic layer 34; and a heater 36 which is located inside the aluminum cored bar, A pressing roller 32 having an external diameter of 40 mm includes:

an aluminum cored bar 37;

an elastic layer 38 having a thickness of 1.5 mm and including a silicone rubber, which is located on the aluminum cored bar 37; and an outermost layer 39 including PFA, which is located on the elastic layer 38.

A paper 41 having an unfixed image 40 thereon is fed in the direction indicated by an arrow.

The fixing separativeness was graded as follows:

Good: The toner-fixable temperature range is not less than 50° C., and the toner does not peel off in the drawing test.

Average: The toner-fixable temperature range is not less than 30° C. and less than 50° C., and the toner partially peels off in the drawing test but no problem in practical use.

Poor: The toner-fixable temperature range is less than 30° C., or the toner peels off in the drawing test.

TABLE 1

| | Dv (μm) | Dn (μm) | Dv/Dn | Average circularity | Tm (° C.) | Compression strength (mN) | Slope (mN/μm) | ΔP/Δd (mN/μm) |
|---|---|---|---|---|---|---|---|---|
| Ex. 1 | 5.7 | 5.0 | 1.14 | 0.98 | 129 | 0.72 | 1.20 | 0.15 |
| Ex. 2 | 5.8 | 5.1 | 1.14 | 0.98 | 132 | 0.83 | 1.20 | 0.22 |
| Ex. 3 | 5.8 | 5.0 | 1.16 | 0.98 | 134 | 0.92 | 1.25 | 0.31 |
| Ex. 4 | 5.7 | 5.0 | 1.14 | 0.98 | 125 | 0.66 | 1.20 | 0.18 |
| Ex. 5 | 5.7 | 5.0 | 1.14 | 0.98 | 132 | 0.77 | 1.20 | 0.21 |
| Ex. 6 | 5.8 | 5.1 | 1.14 | 0.98 | 135 | 0.81 | 1.20 | 0.25 |
| Ex. 7 | 5.7 | 5.0 | 1.14 | 0.98 | 135 | 0.87 | 1.25 | 0.33 |
| Comp. Ex. 1 | 5.8 | 5.2 | 1.12 | 0.95 | 120 | 0.41 | 1.10 | 0.16 |
| Comp. Ex. 2 | 7.6 | 6.5 | 1.17 | 0.97 | 131 | 0.61 | 1.00 | 0.25 |

TABLE 1-continued

| | Dv (μm) | Dn (μm) | Dv/Dn | Average circularity | Tm (° C.) | Compression strength (mN) | Slope (mN/μm) | ΔP/Δd (mN/μm) |
|---|---|---|---|---|---|---|---|---|
| Comp. Ex. 3 | 6.8 | 5.8 | 1.17 | 0.98 | 112 | 0.46 | 1.00 | 0.15 |
| Comp. Ex. 4 | 6.5 | 5.6 | 1.16 | 0.95 | 127 | 0.40 | 1.60 | 0.22 |
| Comp. Ex. 5 | 7.5 | 6.4 | 1.17 | 0.97 | 135 | 1.31 | 1.26 | 0.35 |

TABLE 2

| | Background fouling | Transfer defect | Cleanability | Fixability |
|---|---|---|---|---|
| Ex. 1 | Good | Good | Good | Good |
| Ex. 2 | Good | Good | Good | Good |
| Ex. 3 | Good | Good | Good | Good |
| Ex. 4 | Good | Good | Good | Good |
| Ex. 5 | Good | Good | Good | Good |
| Ex. 6 | Good | Good | Good | Good |
| Ex. 7 | Good | Good | Good | Good |
| Comp. Ex. 1 | Poor | Average | Good | Poor |
| Comp. Ex. 2 | Poor | Good | Poor | Poor |
| Comp. Ex. 3 | Poor | Good | Poor | Good |
| Comp. Ex. 4 | Poor | Average | Good | Good |
| Comp. Ex. 5 | Poor | Good | Poor | Poor |

This document claims priority and contains subject matter related to Japanese Patent Application No, 2006-180786, filed on Jun. 30, 2006, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and Desired to be secured by Letters Patent of the United States is:

1. A toner, comprising:

a binder resin comprising a urethane-modified polyester resin or a urea-modified polyester resin in an amount of from 10 to 20% by weight;

a release agent; and a colorant, wherein the toner has a core-shell structure and a weight average molecular weight of from 8,000 to 15,000; wherein the toner has a displacement-load curve in which a maximum compression strength is from 0.65 to 1.0 mN and a slope of a line through an origin point and a first shoulder is not less than 1.1 mN/μm; and wherein the toner satisfies the following relationships:

$RA(P)\times 0.5>RB(P)$ and $RA(W)\times 0.5>RB(W)$;

wherein RA(P) represents a weight ratio of the colorant included in the core to the core, RA(W) represents a weight ratio of the release agent included in the core to the core, RB(P) represents a weight ratio of the colorant included in the shell to the shell, and RB(W) represents a weight ratio of the release agent included in the shell to the shell.

2. The toner according to claim 1, wherein the displacement-load curve comprises plural shoulders.

3. The toner according to claim 1, wherein the toner has a softening point (Tm) of from 115 to 140° C.

4. The toner according to claim 1, wherein the toner has a volume average particle diameter of from 3 to 8μm.

5. The toner according to claim 1, wherein the release agent comprises at least one member selected from the group consisting of a long-chain hydrocarbon, a polyolefin, and a wax having a carbonyl group, in an amount of from 3 to 15% by weight.

6. The toner according to claim 1, further comprising an external additive comprising a particulate inorganic material.

7. The toner according to claim 6, wherein a product of a volume average particle diameter of the toner and a content of the external additive is from 3 to 20μm·% by weight.

8. The toner according to claim 1, wherein the toner has an average circularity of not less than 0.96.

9. The toner according to claim 1, wherein the core-shell structure has a shell comprising a vinyl copolymer resin.

10. The toner according to claim 1, wherein the shell is formed by a method, comprising:

adding an aqueous dispersion comprising a particulate vinyl copolymer resin to a dispersion comprising core particles to adhere the particulate vinyl copolymer resin to the core particles.

11. The toner according to claim 1, prepared by a wet granulation method.

12. An image forming method, comprising:

forming an electrostatic latent image on an image bearing member;

developing the electrostatic latent image with a toner to form a toner image on the image bearing member, using a developing device comprising a developing roller and a toner layer thickness controlling member, wherein the toner layer thickness controlling member presses the developing roller with a pressing force of from 30 to 100 N/m;

transferring the toner image onto a recording medium; and fixing the toner image on the recording medium, using a fixing device comprising a roller comprising a heater wherein the toner is a toner according to claim 1.

13. The image forming method according to claim 12, wherein the fixing device is an oilless fixing device.

14. An image forming apparatus, comprising:

an image bearing member configured to bear an electrostatic latent image;

a charger configured to charge the image bearing member;

an irradiator configured to irradiate the charged image bearing member with a light beam to form the electrostatic latent image thereon;

a developing device configured to develop the electrostatic latent image with a toner to form a toner image on the image bearing member, comprising a developing roller and a toner layer thickness controlling member, wherein the toner layer thickness controlling member presses the developing roller with a pressing force of from 30 to 100 N/m;

a transfer device configured to transfer the toner image onto a recording medium; and a fixing device configured to fix the toner image on the recording medium, comprising a roller comprising a heater, wherein the toner is a toner according to claim 1.

15. The image forming apparatus according to claim 14, wherein the fixing device is an oilless fixing device.

16. A process cartridge, comprising:

an image bearing member configured to bear an electrostatic latent image; and a developing device configured to develop the electrostatic latent image with a toner to form a toner image on the image bearing member, wherein the developer comprises the toner according to claim 1.

17. The toner according to claim 1, wherein the toner satisfies the following relationships:

$RA(P)\times 0.2>RB(P)$ and $RA(W)\times 0.2>RB(W)$.

18. The toner according to claim 1, wherein the toner satisfies the following relationships:

$RA(P)\times 0.01>RB(P)$ and $RA(W)\times 0.01>RB(W)$.

* * * * *